US010544917B2

(12) United States Patent
Renn et al.

(10) Patent No.: US 10,544,917 B2
(45) Date of Patent: Jan. 28, 2020

(54) SHADE AND WAVELENGTH CONVERTER FOR SOLID STATE LUMINAIRES

(71) Applicant: Express Imaging Systems, LLC, Renton, WA (US)

(72) Inventors: John O. Renn, Lake Forest Park, WA (US); Clare Joyce Robinson, Seattle, WA (US); William G. Reed, Seattle, WA (US)

(73) Assignee: EXPRESS IMAGING SYSTEMS, LLC, Renton, WA (US)

( * ) Notice: Subject to any disclaimer, the term of this patent is extended or adjusted under 35 U.S.C. 154(b) by 297 days.

(21) Appl. No.: 15/681,927

(22) Filed: Aug. 21, 2017

(65) Prior Publication Data

US 2018/0058658 A1 Mar. 1, 2018

Related U.S. Application Data

(60) Provisional application No. 62/379,037, filed on Aug. 24, 2016.

(51) Int. Cl.

| | |
|---|---|
| ***F21V 1/08*** | (2006.01) |
| ***F21V 1/22*** | (2006.01) |
| ***F21V 1/12*** | (2006.01) |

(52) U.S. Cl.

CPC ..... *F21V 1/08* (2013.01); *F21V 1/12* (2013.01); *F21V 1/22* (2013.01)

(58) Field of Classification Search

CPC ..... F21V 1/08; F21V 1/12; F21V 1/22; F21V 1/00; F21V 1/10; F21V 1/16; F21V 1/17;

(Continued)

(56) References Cited

U.S. PATENT DOCUMENTS 413,469 A * 10/1889 Woodward ..... F21V 1/08 362/417
1,868,776 A * 7/1932 Tate ..... F21V 1/00 362/360

(Continued)

FOREIGN PATENT DOCUMENTS

CN 103162187 A 6/2013
EP 2 068 193 A2 6/2009

(Continued)

OTHER PUBLICATIONS

Communication pursuant to Article 94(3) EPC, dated Feb. 5, 2016, for corresponding European Application No. 11 733 467.2-1755, 7 pages.

(Continued)

*Primary Examiner* — Bao Q Truong
(74) *Attorney, Agent, or Firm* — Cozen O'Connor

(57) ABSTRACT

Shades and/or reflectors for luminaires. The luminaires may be retrofitted with the shades and/or reflectors to selectively control the direction and/or spectrum of light emitted by the luminaires. In particular, the efficiency and/or color contrast of a luminaire may be improved by using wavelength shifting material, such as a phosphor, to absorb less desired wavelengths and transmit more desired wavelengths. The shade may provide a transmissive filter which reflects desired wavelengths such as red and green, while passing less desired wavelengths (e.g., blue) toward the wavelength shifting material which emits such as light of more desirable wavelengths.

16 Claims, 13 Drawing Sheets

(58) Field of Classification Search
CPC ... F21V 1/14; F21V 1/146; F21V 1/24; F21V 7/00
See application file for complete search history.

(56) References Cited

U.S. PATENT DOCUMENTS

| | | | | |
|---|---|---|---|---|
| 3,308,290 | A * | 3/1967 | Brown | F21S 6/002 362/295 |
| 4,001,576 | A * | 1/1977 | Goddard | F21V 1/00 362/307 |
| 5,051,879 | A * | 9/1991 | Bunger | A47G 33/0836 362/351 |
| 5,858,488 | A * | 1/1999 | Cohon | F21V 1/22 362/351 |
| 6,206,551 | B1 * | 3/2001 | Stubblefield, Jr. | F21L 19/00 362/283 |
| 6,729,747 | B1 * | 5/2004 | Wirayani | F21V 1/12 362/355 |
| 6,746,274 | B1 | 6/2004 | Verfuerth | |
| 7,250,715 | B2 | 7/2007 | Mueller et al. | |
| 7,638,743 | B2 | 12/2009 | Bartol et al. | |
| 8,118,456 | B2 | 2/2012 | Reed et al. | |
| 8,169,135 | B2 | 5/2012 | Zhai et al. | |
| 8,334,640 | B2 | 12/2012 | Reed et al. | |
| 8,344,665 | B2 | 1/2013 | Verfuerth et al. | |
| 8,378,563 | B2 | 2/2013 | Reed et al. | |
| 8,406,937 | B2 | 3/2013 | Verfuerth et al. | |
| 8,445,826 | B2 | 5/2013 | Verfuerth | |
| 8,450,670 | B2 | 5/2013 | Verfuerth et al. | |
| 8,476,565 | B2 | 7/2013 | Verfuerth | |
| 8,508,137 | B2 | 8/2013 | Reed | |
| 8,541,950 | B2 | 9/2013 | Reed | |
| 8,545,029 | B2 | 10/2013 | Ma et al. | |
| 8,586,902 | B2 | 11/2013 | Verfuerth | |
| 8,604,701 | B2 | 12/2013 | Verfuerth et al. | |
| 8,610,358 | B2 | 12/2013 | Reed | |
| 8,629,621 | B2 | 1/2014 | Reed | |
| 8,637,877 | B2 | 1/2014 | Negley | |
| 8,666,559 | B2 | 3/2014 | Verfuerth et al. | |
| 8,779,340 | B2 | 7/2014 | Verfuerth et al. | |
| 8,810,138 | B2 | 8/2014 | Reed | |
| 8,866,582 | B2 | 10/2014 | Verfuerth et al. | |
| 8,872,964 | B2 | 10/2014 | Reed et al. | |
| 8,878,440 | B2 | 11/2014 | Reed | |
| 8,884,203 | B2 | 11/2014 | Verfuerth et al. | |
| 8,896,215 | B2 | 11/2014 | Reed et al. | |
| 8,901,825 | B2 | 12/2014 | Reed | |
| 8,922,124 | B2 | 12/2014 | Reed et al. | |
| 8,926,138 | B2 | 1/2015 | Reed et al. | |
| 8,926,139 | B2 | 1/2015 | Reed et al. | |
| 8,987,992 | B2 | 3/2015 | Reed | |
| 9,185,777 | B2 | 11/2015 | Reed | |
| 9,204,523 | B2 | 12/2015 | Reed et al. | |
| 9,210,751 | B2 | 12/2015 | Reed | |
| 9,210,759 | B2 | 12/2015 | Reed | |
| 9,288,873 | B2 | 3/2016 | Reed | |
| 9,312,451 | B2 | 4/2016 | Reed et al. | |
| 9,414,449 | B2 | 8/2016 | Reed | |
| 9,466,443 | B2 | 10/2016 | Reed | |
| 9,693,433 | B2 | 6/2017 | Reed et al. | |
| 9,713,228 | B2 | 7/2017 | Reed | |
| 2003/0016523 | A1 * | 1/2003 | Pickens | F21V 1/10 362/35 |
| 2006/0002116 | A1 * | 1/2006 | Lin | F21V 1/00 362/351 |
| 2006/0145172 | A1 | 7/2006 | Su et al. | |
| 2007/0285000 | A1 | 12/2007 | Lim et al. | |
| 2008/0284316 | A1 | 11/2008 | Kurihara et al. | |
| 2009/0101930 | A1 | 4/2009 | Li | |
| 2010/0123403 | A1 | 5/2010 | Reed | |
| 2010/0149483 | A1 | 6/2010 | Chiavetta, III | |
| 2010/0259924 | A1 | 10/2010 | Dong | |
| 2011/0026264 | A1 | 2/2011 | Reed et al. | |
| 2011/0310605 | A1 | 12/2011 | Renn et al. | |
| 2012/0038490 | A1 | 2/2012 | Verfuerth | |
| 2012/0209755 | A1 | 8/2012 | Verfuerth et al. | |
| 2012/0224363 | A1 | 9/2012 | Van De Ven | |
| 2013/0033183 | A1 | 2/2013 | Verfuerth et al. | |
| 2013/0131882 | A1 | 5/2013 | Verfuerth et al. | |
| 2013/0163243 | A1 | 6/2013 | Reed | |
| 2014/0028198 | A1 | 1/2014 | Reed et al. | |
| 2014/0055990 | A1 | 2/2014 | Reed | |
| 2014/0078308 | A1 | 3/2014 | Verfuerth | |
| 2014/0097759 | A1 | 4/2014 | Verfuerth et al. | |
| 2014/0159585 | A1 | 6/2014 | Reed | |
| 2014/0180491 | A1 | 6/2014 | Verfuerth et al. | |
| 2015/0015716 | A1 | 1/2015 | Reed et al. | |
| 2015/0078005 | A1 | 3/2015 | Renn et al. | |
| 2017/0089531 | A1 * | 3/2017 | Prince | F21S 6/005 |
| 2017/0164439 | A1 | 6/2017 | Reed | |

FOREIGN PATENT DOCUMENTS

| | | | |
|---|---|---|---|
| JP | 11-45519 | A | 2/1999 |
| JP | 2004-193580 | A | 7/2004 |
| JP | 2004-193581 | A | 7/2004 |
| JP | 2008-010518 | A | 1/2008 |
| JP | 2009-071254 | A | 4/2009 |
| JP | 2009-105379 | A | 5/2009 |
| JP | 2009-251511 | A | 10/2009 |
| JP | 2010-250259 | A | 11/2010 |
| JP | 2011-501362 | A | 1/2011 |
| JP | 2011-528490 | A | 11/2011 |
| WO | 2004/068182 | A2 | 8/2004 |
| WO | 2009/052093 | A1 | 4/2009 |
| WO | 2009/107052 | A1 | 9/2009 |
| WO | 2009/137696 | A1 | 11/2009 |
| WO | 2009/140141 | A1 | 11/2009 |
| WO | 2010/057115 | A2 | 5/2010 |
| WO | 2010/127138 | A2 | 11/2010 |
| WO | 2010/133719 | A1 | 11/2010 |
| WO | 2010/135575 | A2 | 11/2010 |
| WO | 2010/135577 | A2 | 11/2010 |
| WO | 2010/135582 | A2 | 11/2010 |
| WO | 2011/088363 | A2 | 7/2011 |
| WO | 2011/163334 | A1 | 12/2011 |
| WO | 2012/142115 | A2 | 10/2012 |
| WO | 2013/028834 | A1 | 2/2013 |
| WO | 2013/040333 | A1 | 3/2013 |
| WO | 2014/018773 | A1 | 1/2014 |
| WO | 2014/039683 | A1 | 3/2014 |
| WO | 2014/078854 | A1 | 5/2014 |
| WO | 2015/013437 | A1 | 1/2015 |
| WO | 2015/039120 | A1 | 3/2015 |
| WO | 2015/116812 | A1 | 8/2015 |
| WO | 2016/054085 | A1 | 4/2016 |
| WO | 2016/064542 | A1 | 4/2016 |
| WO | 2016/081071 | A1 | 5/2016 |

OTHER PUBLICATIONS

Communication pursuant to Article 94(3) EPC, dated Jun. 3, 2015, for corresponding European Application No. 11 733 467.2-1755, 12 pages.

Extended European Search Report, dated Feb. 17, 2015, for corresponding European Application No. 12832462.1, 8 pages.

Extended European Search Report, dated Sep. 11, 2014, for corresponding European Application No. 11733467.2, 5 pages.

International Search Report, dated Jan. 2, 2013, for PCT/US2012/055379, 3 pages.

International Search Report, dated Sep. 30, 2011, for PCT/US2011/021359, 3 pages.

Japanese Office Action, dated Apr. 7, 2015, for corresponding Japanese Application No. 2012-549127, with English Translation, 7 pages.

Japanese Office Action, dated Sep. 9, 2014, for corresponding Japanese Application No. 2012-549127, with English translation, 7 pages.

Reed et al., "Adjustable Output Solid-State Lamp With Security Features," U.S. Appl. No. 61/561,616, filed Nov. 18, 2011, 33 pages.

(56) References Cited

OTHER PUBLICATIONS

Reed et al., "Apparatus, Method to Change Light Source Color Temperature With Reduced Optical Filtering Losses," Notice of Allowance, dated Oct. 15, 2012, for U.S. Appl. No. 13/007,080, 9 pages.
Reed et al., "Apparatus, Method to Change Light Source Color Temperature with Reduced Optical Filtering Losses,"U.S. Appl. No. 61/295,519, filed Jan. 15, 2010, 35 pages.
Reed et al., "Apparatus, Method to Change Light Source Color Temperature With Reduced Optical Filtering Losses,"U.S. Appl. No. 61/406,490, filed Oct. 25, 2010, 46 pages.
Reed et al., "Apparatus, Method to Enhance Color Contrast in Phosphor-Based Solid State Lights," U.S. Appl. No. 13/619,085, Amendment filed Aug. 20, 2015, 14 pages.
Reed et al., "Apparatus, Method to Enhance Color Contrast in Phosphor-Based Solid State Lights," U.S. Appl. No. 13/619,085, Notice of Allowance dated Dec. 2, 2015, 9 pages.
Reed et al., "Apparatus, Method to Enhance Color Contrast in Phosphor-Based Solid State Lights," U.S. Appl. No. 13/619,085, Office Action dated May 20, 2015, 13 pages.
Reed et al., "Apparatus, Method to Enhance Color Contrast in Phosphor-Based Solid State Lights," U.S. Appl. No. 61/534,722, filed Sep. 14, 2011, 53 pages.
Reed et al., "Long-Range Motion Detection for Illumination Control,"U. S. Appl. No. 61/180,017, filed May 20, 2009, 32 pages.
Reed et al., "Low-Profile Pathway Illumination System," U.S. Appl. No. 61/051,619, filed May 8, 2008, 25 pages.
Reed et al., "Remotely Adjustable Solid-State Lamp,"U.S. Appl. No. 61/641,781, filed May 2, 2012, 65 pages.
Reed, "Adjustable Output Solid-State Lighting Device,"U.S. Appl. No. 61/567,308, filed Dec. 6, 2011, 49 pages.
Reed, "Aluminaire With Transmissive Filter and Adjustable Illumination Pattern," U.S. Appl. No. 62/264,694, filed Dec. 8, 2015, 78 pages.
Reed, "Ambient Light Control in Solid State Lamps and Luminaires,"U. S. Appl. No. 61/933,733, filed Jan. 30, 2014, 8 pages.
Reed, "Apparatus and Method of Energy Efficient Illumination," U.S. Appl. No. 61/346,263, filed May 19, 2010, 67 pages.
Reed, "Apparatus and Method of Energy Efficient Illumination,"U. S. Appl. No. 61/333,983, filed May 12, 2010, 57 pages.
Reed, "Apparatus, Retrofit Kit, and Method of Energy Efficient Illumination Using Adjustment Schedules," U.S. Appl. No. 62/208,403, filed Aug. 21, 2015, 100 pages.
Reed, "Asset Management System for Outdoor Luminaires," U.S. Appl. No. 62/082,463, filed Nov. 20, 2014, 56 pages.
Reed, "Detection and Correction of Faulty Photo Controls in Outdoor Luminaires," U.S. Appl. No. 62/068,517, filed Oct. 24, 2014, 47 pages.
Reed, "Detection and Correction of Faulty Photo Controls in Outdoor Luminaires," U.S. Appl. No. 62/183,505, filed Jun. 23, 2015, 71 pages.
Reed, "Electronic Control to Regulate Power for Solid-State Lighting and Methods Thereof," U.S. Appl. No. 61/115,438, filed Nov. 17, 2008, 51 pages.
Reed, "Electronic Control to Regulate Power for Solid-State Lighting and Methods Thereof," U.S. Appl. No. 61/154,619, filed Feb. 23, 2009, 62 pages.
Reed, "High Efficiency Power Controller for Luminaire,"U.S. Appl. No. 61/905,699, filed Nov. 18, 2013, 5 pages.
Reed, "Low Power Photocontrol for Luminaire,"U.S. Appl. No. 62/137,666, filed Mar. 24, 2015, 36 pages.
Reed, "Luminaire With Atmospheric Electrical Activity Detection and Visual Alert Capabilities,"U.S. Appl. No. 61/649,159, filed Aug. 28, 2012, 52 pages.
Reed, "Luminaire With Switch-Mode Converter Power Monitoring,"U. S. Appl. No. 61/723,675, filed Nov. 7, 2012, 73 pages.
Reed, "Photocontrol for Luminaire Consumes Very Low Power,"U. S. Appl. No. 61/849,841, filed Jul. 24, 2013, 41 pages.
Reed, "Resonant Network for Reduction of Flicker Perception in Solid State Lighting Systems," U.S. Appl. No. 61/527,029, filed Aug. 24, 2011, 41 pages.
Reed, "Solid State Hospitality Lamp," U.S. Appl. No. 61/692,619, filed Aug. 23, 2012, 32 pages.
Reed, "Solid State Lighting, Drive Circuit and Method of Driving Same," U.S. Appl. No. 61/640,963, filed May 1, 2012, 24 pages.
Reed, "Systems, Methods, and Apparatuses for Using a High Current Switching Device As a Logic Level Sensor," U.S. Appl. No. 61/764,395, filed Feb. 13, 2013, 48 pages.
Reed, "Luminaire With Adjustable Illumination Pattern," U.S. Appl. No. 62/114,826, filed Feb. 11, 2015, 68 pages.
Renn et al., "Solid-State Lighting Devices and Systems," U.S. Appl. No. 61/878,425, filed Sep. 16, 2013, 32 pages.
Written Opinion, dated Jan. 2, 2013, for PCT/US2012/055379, 5 pages.
Written Opinion, dated Sep. 30, 2011, for PCT/US2011/021359, 4 pages.
Notice of Allowance, dated Jan. 8, 2018, for U.S. Appl. No. 15/369,559, Reed, "Luminaire With Transmissive Filter and Adjustable Illumination Pattern," 19 pages.
Communication pursuant to Article 94(3) EPC, dated Feb. 19, 2018, for European Application No. 11 733 467.2-1013, 7 pages.

* cited by examiner

SHADE AND WAVELENGTH CONVERTER FOR SOLID STATE LUMINAIRES

BACKGROUND

Field

This disclosure generally relates to shades and reflectors for luminaires that employ active light sources.

Description of the Related Art

Luminaires exist in a broad range of designs suitable for various uses. Some luminaires illuminate interior spaces, while others illuminate exterior spaces. Some luminaires are used to provide information, for example, forming part of or all of a display panel. Active lighting sources take a variety of forms, for example incandescent lamps, high-intensity discharge (HID) lamps (e.g., mercury vapor lamps, high-pressure sodium lamps, metal halide lamps), and solid-state light sources for instance light emitting diodes (LEDs).

Luminaires have a number of defining characteristics, including intensity (e.g., lumens), focus or dispersion, and temperature of the emitted light. For light sources that emit light by thermal radiation (e.g., incandescent filament), the color temperature (CT) of the light source is the temperature of an ideal black-body radiator that radiates light of comparable hue to that of the light source. Light sources that emit light by processes other than thermal radiation (e.g., solid state light sources) do not follow the form of a black-body spectrum. These light sources are assigned various correlated color temperatures (CCT) to indicate, to human color perception, the color temperature that most closely matches the light emitted.

Achieving desired lighting typically requires selecting suitable light sources, lenses, reflectors and/or housings based at least in part on the defining characteristics, the environment in which the luminaire will be used, and the desired level of performance.

LEDs are becoming increasingly popular due to their high energy efficiency, robustness, and long life performance. Typically, practical LEDs are capable of emitting light in a relatively narrow band. Since white light is often desirable, solid-state lighting systems typically employ "white" LEDs. These "white" LEDs may be manufactured by placing a phosphor layer either directly on a blue emitting LED die or onto a lens or window through which an LED will emit light. The phosphor layer is typically designed to convert radiation in the 440 nanometer to 480 nanometer wavelength range (mostly blue light) into a wider spectrum consisting of longer visible wavelengths that, when added to residual blue light, will appear as a pleasing white light. A variety of white LEDs are commercially available from a variety of manufacturers. Commercially available white LEDs range from "cool" white with a CCT of approximately 6000 Kelvin (K) to "warm" white with a CCT of approximately 3000 K.

In addition to the performance parameters described above, lighting of homes, offices and other areas often has aesthetic concerns that are as important as the amount of illumination produced by the lighting system. Unlike an ideal black body radiator or natural daylight, solid-state lighting systems do not produce light that has a smooth and continuous spectral power distribution, despite the appearance of "white" light.

It is known that phosphor-coated white LEDs permit some blue light to escape conversion by the phosphor. The blue light differs from natural light and also may appear harsh or otherwise unpleasing. In addition, other aesthetic concerns often favor an emission spectrum that has more red and green wavelengths than would come from a true black body radiator. This type of light enhances the colors and color contrasts of furnishings and décor.

Although red and green light can be added to white LEDs to provide a more pleasing spectrum, this method may result in significant added cost for the extra LEDs and drive electronics, while the blue wavelength spike in the output spectrum remains.

Absorption filtered lamps, such as the General Electric's REVEAL® light bulbs, typically incorporate a filter element, such as neodymium, into the glass bulb to filter out the dull yellow light produced by the incandescent filament, thereby enhancing the appearance of the more vibrant light such as red. The addition of such a filter, however, causes a significant loss of light output, leading to a very low efficiency. For example, a REVEAL® 60W bulb has a Lumens/Watt rating of only 11. Although an LED lamp may have a rating of 65 L/W to 100 L/W, it can be expected that adding absorption filters would similarly reduce the efficiency as well as the light output, because the undesirable light is filtered and dissipated as heat. The heat added to the system from the absorptive filter may also contribute to lowering the life expectancy of the LED.

Adjusting the phosphor formulation of white LED lamps is also inadequate in providing the desired pleasing light in an LED, due to the wideband nature of the phosphor's emission spectrum. In other words, a narrow band of wavelengths typically cannot be removed from the white LED output spectrum by adjusting the phosphor formulation.

Lighting systems are designed to have specific illumination patterns, for example, outdoor luminaires may have National Electrical Manufacturers Association (NEMA) Type 1, 2, 3, 4 or 5 illumination patterns. Indoor applications may require unique illumination patterns to properly light complex interior spaces, for example retail stores. Other non-standardized light patterns are desirable in some installations, to provide higher light levels in certain locations and lower light levels in other locations. For example, a NEMA Type 5 outdoor luminaire is designed to provide light in a square or circular pattern on the ground, whereas a NEMA Type 3 pattern has an oblong light distribution more suitable for roadway lighting.

In some installations, none of the standard illumination patterns is acceptable. For example, a NEMA Type 5 luminaire mounted near a residence may properly illuminate a yard, driveway and/or street, but may also project an objectionable amount of light into the windows of the residence.

BRIEF SUMMARY

A shade to control an illumination pattern of a luminaire may be summarized as including a sheet of material which is at least one of optically transparent or optically translucent, the sheet having inner and outer arcuate edges concentric about a central axis, the inner and outer arcuate edges extending between first and second ends of the sheet, the sheet bendable by a user to overlap portions of the sheet adjacent the first and second ends to form the sheet into the shape of a truncated cone with at least a portion of the inner edge fitting around a neck portion of the luminaire disposed at least one of above or below at least one light source of the luminaire, and a filter portion of the sheet of material is formed of or coated with an optical filter material which transmits light incident on the filter portion having a wavelength in a first set of wavelengths and one of reflects or absorbs light incident on the filter portion having a wavelength in a second set of wavelengths; and a fastener which selectively maintains the sheet in the shape of the truncated cone around the neck portion of the luminaire. The second set of wavelengths may include wavelengths below 480 nanometers. The filter portion may include a dielectric coating disposed on at least one surface of the sheet. The filter portion may include a layer of coating disposed on at least one surface of the sheet. The filter portion may include one or more layers of at least one of a dichroic coating or a dielectric mirror material. The shade may be selectively installable in a first configuration and a second configuration, in the first configuration the truncated cone shape of the sheet may open toward the at least one light source of the luminaire, and in the second configuration the truncated cone shape of the sheet may open away from the at least one light source of the luminaire. The fastener may include at least one of: a rivet fastener, a tab and slot fastener, an adhesive, or a hook and loop fastener. The fastener may include a first fastener fixedly coupled to the sheet proximate the first end thereof and a second fastener fixedly coupled to the sheet proximate the second end thereof, the first fastener selectively engageable with the second fastener. The shade may be selectively rotatable about the central axis subsequent to installation around the neck portion of the luminaire.

The shade may further include a secondary shade attachment portion disposed proximate at least a portion of the outer arcuate edge of the sheet, the secondary shade attachment portion selectively attaches a secondary shade to the shade.

A shade to control an illumination pattern of a luminaire may be summarized as including a sheet of material which is at least one of optically transparent or optically translucent, the sheet having inner and outer arcuate edges concentric about a central axis, the inner and outer arcuate edges extending between first and second ends of the sheet, the sheet bendable by a user to overlap portions of the sheet adjacent the first and second ends to form the sheet into the shape of a truncated cone with at least a portion of the inner edge fitting around a neck portion of the luminaire disposed at least one of above or below at least one light source of the luminaire, and the sheet of material comprises a wavelength shifter portion which receives light from the at least one light source of the luminaire on a first surface of the sheet and in response emits light at a shifted wavelength on a second surface of the sheet, the second surface opposite the first surface; and a fastener which selectively maintains the sheet in the shape of the truncated cone around the neck portion of the luminaire. The wavelength shifter portion may emit light at wavelengths above 480 nanometers. The wavelength shifter portion may include the sheet loaded with phosphor. The wavelength shifter portion may include the sheet loaded with a europium doped strontium-barium silicate phosphor. The wavelength shifter portion may include a layer of coating disposed on at least one surface of the sheet of material. The wavelength shifter portion may include a coating of quantum dots disposed on at least one surface of the sheet of material. The shade may be selectively installable in a first configuration and a second configuration, in the first configuration the truncated cone shape of the sheet may open toward the at least one light source of the luminaire, and in the second configuration the truncated cone shape of the sheet may open away from the at least one light source of the luminaire. The fastener may include at least one of: a rivet fastener, a tab and slot fastener, an adhesive, or a hook and loop fastener. The fastener may include a first fastener fixedly coupled to the sheet proximate the first end thereof and a second fastener fixedly coupled to the sheet proximate the second end thereof, the first fastener selectively engageable with the second fastener. The shade may be selectively rotatable about the central axis subsequent to installation around the neck portion of the luminaire.

The shade may further include a secondary shade attachment portion disposed proximate at least a portion of the outer arcuate edge of the sheet, the secondary shade attachment portion selectively attaches a secondary shade to the shade.

A shade assembly to control an illumination pattern of a luminaire may be summarized as including a primary shade comprising a sheet of material having inner and outer arcuate edges concentric about a central axis, the inner and outer arcuate edges extending between first and second ends of the sheet, the sheet bendable by a user to overlap portions of the sheet adjacent the first and second ends to form the sheet into the shape of a truncated cone with at least a portion of the inner edge fitting around a neck portion of the luminaire disposed at least one of above or below at least one light source of the luminaire, the sheet of material comprises at least one reflective surface; a fastener which selectively maintains the sheet in the shape of the truncated cone around the neck portion of the luminaire; and a secondary shade that is selectively attachable to the primary shade. The sheet of material of the primary shade may include a sheet of microcellular formed polyethylene terephthalate (MCPET). The secondary shade may include a sheet of material which, when attached to the shade, extends from at least a portion of the outer arcuate edge of the primary shade toward the at least one light source of the luminaire. The secondary shade may extend from at least 25 percent of the outer arcuate edge of the primary shade. The secondary shade may extend from at least 50 percent of the outer arcuate edge of the primary shade. The secondary shade may be at least one of optically transparent or optically translucent. The secondary shade may be formed of or coated with an optical filter material which transmits light incident on the secondary shade having a wavelength in a first set of wavelengths and one of reflects or absorbs light incident on the secondary shade having a wavelength in a second set of wavelengths. The secondary shade may be formed of or coated with an optical filter material which one of reflects or absorbs light incident on the secondary shade having a wavelength below 480 nanometers. At least one surface of the secondary shade may include a dielectric coating disposed thereon.

The secondary shade may include a wavelength shifter portion which receives light from the at least one light source of the luminaire on a first surface of the secondary shade and in response emits light at a shifted wavelength on a second surface of the secondary shade, the second surface of the secondary shade opposite the first surface of the secondary shade. The wavelength shifter portion of the secondary shade may emit light at wavelengths above 480 nanometers. The wavelength shifter portion of the secondary shade may include the sheet loaded with phosphor. The wavelength shifter portion of the secondary shade may include the secondary shade loaded with a europium doped strontium-barium silicate phosphor. The wavelength shifter portion of the secondary shade may include a coating of quantum dots disposed on at least one surface of the secondary shade. At least one surface of the secondary shade may include a reflective surface. The secondary shade may include a sheet of microcellular formed polyethylene terephthalate (MCPET).

A shade to control an illumination pattern of a luminaire, the luminaire comprising a neck portion may be summarized as including a truncated cone-shaped unitary piece of material formed from an elastomeric resin, the material having a first end and a second end opposite the first end, the first end having a first opening which has first diameter and the second end having a second opening which has a second diameter, the second diameter larger than the first diameter, the first diameter smaller than a relatively larger portion of the luminaire disposed between an end of the luminaire and the neck portion, and the material elastically deformable to stretch the first opening of the first end over the relatively larger portion of the luminaire to position the first end adjacent the neck portion of the luminaire. The material may be formed from molded liquid silicone rubber. The material may be at least one of optically transparent or optically translucent. A filter portion of the material may be coated with an optical filter material which transmits light incident on the filter portion having a wavelength in a first set of wavelengths and one of reflects or absorbs light incident on the filter portion having a wavelength in a second set of wavelengths. The second set of wavelengths may include wavelengths below 480 nanometers. The filter portion may include a dielectric coating disposed on at least one surface of the material. The filter portion may include a layer of coating disposed on at least one surface of the material. The filter portion may include one or more layers of at least one of a dichroic coating or a dielectric mirror material.

The material may include a wavelength shifter portion which receives light from at least one light source of the luminaire on a first surface of the material and in response emits light at a shifted wavelength on a second surface of the material, the second surface opposite the first surface. The wavelength shifter portion may emit light at wavelengths above 480 nanometers. The wavelength shifter portion may include the material loaded with phosphor. At least one surface of the material may include a reflective surface. The shade may be selectively rotatable about a central axis subsequent to installation around the neck portion of the luminaire.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

Figure 1:
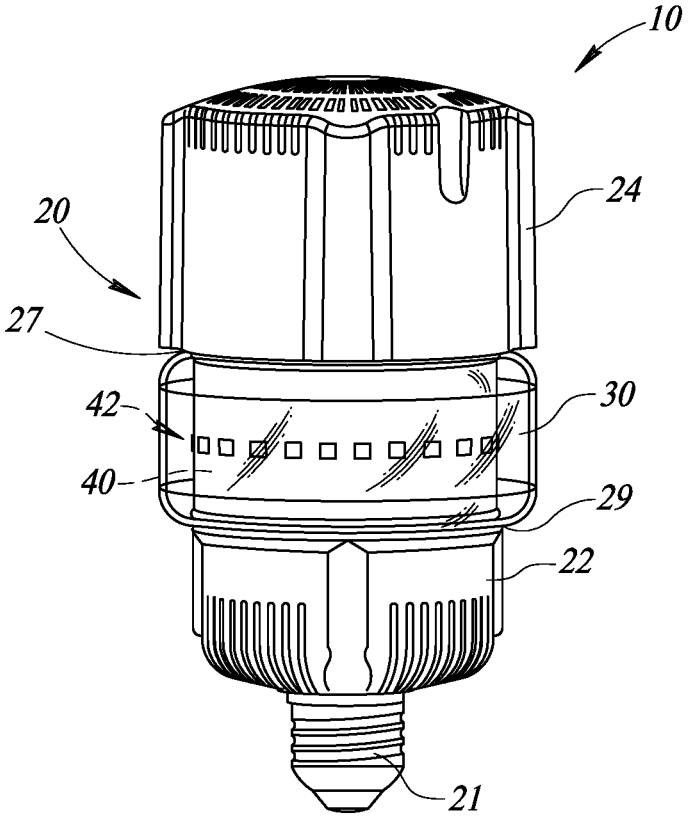
FIG. 1 is a perspective view of a solid-state lighting device or luminaire with which one or more shades of the present disclosure may be used, according to one illustrated implementation.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with computer systems, server computers, and/or communications networks have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the implementations.

Described herein are apparatus and method for minimizing or eliminating undesirable light while enhancing desirable light of solid state lighting sources without causing significant losses in energy and light output. In particular, one or more implementations of the present disclosure provide systems to control the light distribution and color temperature of solid state luminaires to avoid light trespass or complaints of high color temperature light being present in certain areas, such as pedestrian or residential areas. Solid state light emitters, such as LEDs, may contain wavelengths of light which are suitable for roadways but are undesirable for other areas (e.g., residences, sidewalks). For example, a luminaire that emits light in wide angles may be suitable for illuminating a side of the luminaire which faces a street or roadway, referred to herein as "street side" or "SS," but may not be desirable for a side of the luminaire which faces a residence, referred to herein as a "house side" or "HS" of the luminaire.

At least one implementation of the present disclosure provides an adjustable reflector, shade, filter or wavelength shifter, referred to generally herein as a "shade," which modifies the light projected onto one area, or wavelength shifts or converts shorter wavelengths of light to longer, more desirable, wavelengths in one or more directions from the luminaire source. At least one implementation of the present disclosure provides an adjustable shade which is selectively attachable to a solid-state retrofit luminaire, such as the solid-state luminaire shown in FIG. 1 and discussed below. Implementations of the present disclosure may be designed to additionally or alternatively work with other types of luminaires (e.g., "corn cob" light retrofit luminaires).

One or more of the implementations of the shades discussed herein are particularly well-suited for use with luminaires which may be replacements for conventional gas discharge lamps. The luminaires may have a form factor that is sized and shaped to fit within a cylindrical envelope similar to such conventional gas discharge lamps. The luminaires may also have a same or similar light center length and may generate light with an intensity and/or a distribution that is substantially similar to that of conventional gas discharge lamps. Accordingly, the luminaires may serve as drop-in replacements for conventional gas discharge lamps with little to no appreciable difference in lighting characteristics.

As an example, implementations described herein provide shades for solid-state luminaires having a plurality of solid-state light emitters (e.g., LEDs) arranged to produce light at a location substantially consistent with the burn center or light center length of conventional gas discharge lamps. Optical reflectors, lenses and the physical configuration of the solid-state luminaires described herein may direct light in a manner that is nearly identical or very similar to the conventional gas discharge lamps that the luminaires replace, so that the luminaires provide a light distribution expected from the replaced lamps.

FIG. 1 shows one example implementation of a solid-state lighting device or luminaire 10 with which the shades discussed herein may be used. The luminaire 10 includes a housing 20 having a base housing portion 22 and a head housing portion 24 that is distinct from the base housing portion 22. A lens 30 is positioned between the base housing portion 22 and the head housing portion 24. A first relatively narrow diameter portion 27, referred to herein as a first "neck" portion or lens-head interface, is disposed between the lens 30 and the head housing portion 24. A second relatively narrow diameter portion 29, referred to herein as a second "neck" portion or lens-base interface, is disposed between the lens 30 and the base housing portion 22. As discussed further below, the various shades discussed herein may be selectively coupled around either of the first or second neck portions 27 and 29 of the luminaire 10. The base housing portion 22, the head housing portion 24 and the intermediate lens 30 collectively define an outer contour or form factor of the luminaire 10. The lens 30 may be tubular or annular and may include a central cavity within which other components of the lighting device 10 may be received. The lens 30 may comprise one or more materials to diffuse, refract and/or diffract light passing therethrough during operation of the lighting device 10.

The lens 30 may be placed around a plurality of solid-state light emitters 42 (e.g., LEDs) to protect them from moisture or other physical damage, and to diffuse light generated by the light emitters 42 so that the light has a pleasing appearance and is similar in appearance to light emanating from a gas discharge lamp. The lens 30 may comprise refractive or diffractive properties which may be used to produce a desired light pattern.

The base housing portion 22 and the head housing portions 24 may be shell structures that include one or more internal cavities for receiving other components of the lighting device 10. The base housing portion 22 and the head housing portions 24 may by cup-like structures. When assembled, the base housing portion 22, the head housing portions 24 and the lens 30 may form a vessel to carry functional components of the lighting device 10. The housing 20 may further include a threaded base 21 to physically and electrically couple the luminaire 10 to a lighting fixture. In other instances, the threaded base 21 may physically couple the lighting device 10 to a lighting fixture and a separate or distinct interconnect device may be provided to electrically couple the luminaire 10 to a power source (e.g., AC mains power). The interconnect device may be, for example, a wiring harness having a plurality of discrete wires (i.e., a pig tail) or a plurality of electrical connectors, such as, for example, twist-lock pin connectors such as GU series connectors. The housing portions may be made from a white or other highly reflective material.

The plurality of solid-state light emitters 42 (e.g., LEDs) may be carried by a circuit board 40 and arranged to generate light to pass through the lens 30 during operation. The solid-state light emitters 42 may each have a respective principal axis of emission, which typically extends perpendicularly from an outer surface of the solid-state light emitters 42. The solid-state light emitters 42 may be arrayed about a central or longitudinal axis, with their respective principal axes of emission extending radially outward from the central or longitudinal axis, for example in a 360 degree pattern.

Figure 2:
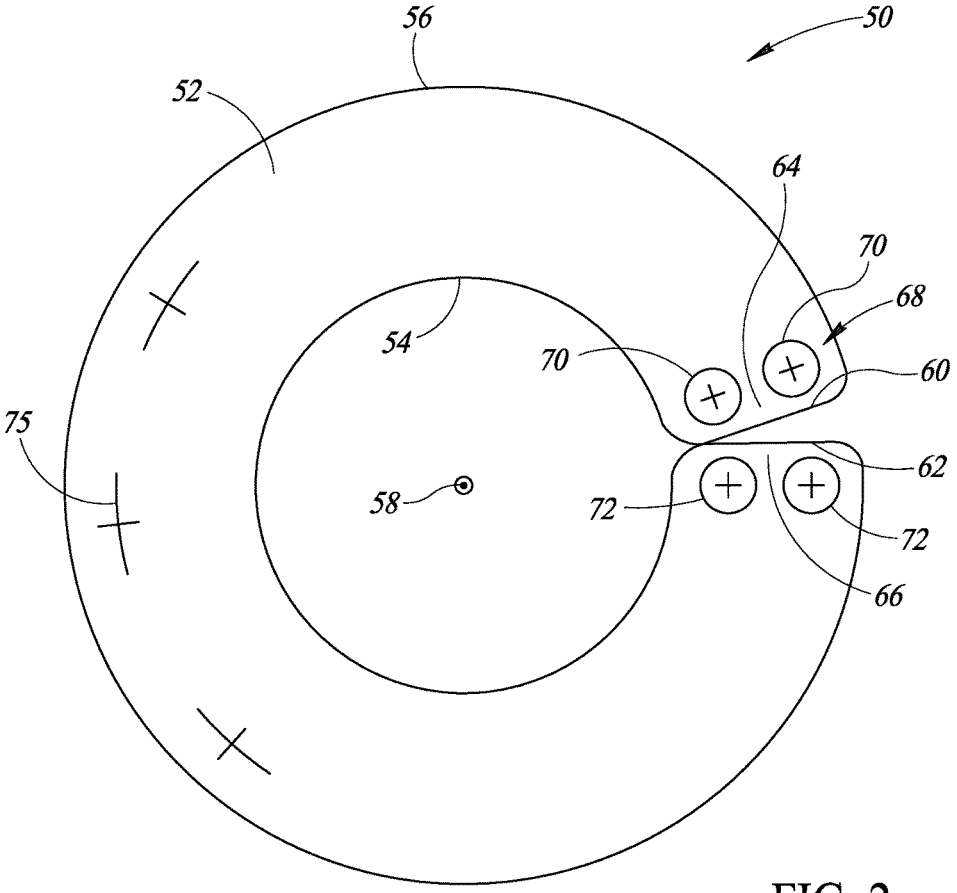
FIG. 2 is a top plan view of a shade which is selectively attachable to a luminaire, according to one illustrated implementation.
Figure 3:
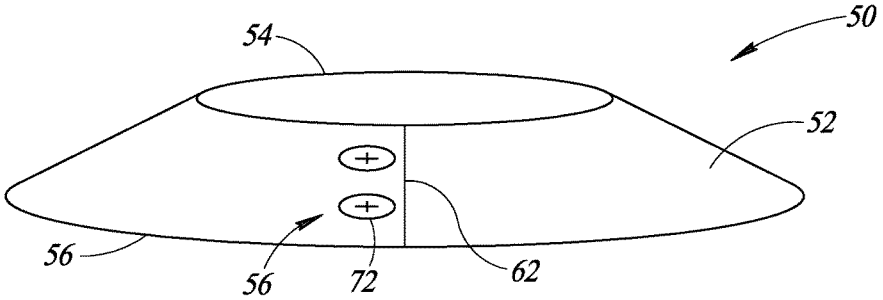
FIG. 3 is a perspective view of the shade of FIG. 2, according to one illustrated implementation.

FIG. 2 shows a top view of a primary shade 50 ("shade") prior to installation which may be used to control an illumination pattern of a luminaire, such as the luminaire 10 shown in FIG. 1. FIG. 3 shows the shade 50 of FIG. 2 when configured for attachment to a luminaire, and FIGS. 4A-4D show the shade when selectively attached to the luminaire 10 of FIG. 1 in various installation configurations.

The shade 50 includes a sheet 52 of material which has an inner arcuate edge 54 and an outer arcuate edge 56 concentric about a central axis 58. The inner arcuate edge 54 and the outer arcuate edge 56 each extend between a first end 60 and a second end 62 of the sheet 52. As an example, the sheet 52 may be laser or die cut from a suitable flat material, as discussed further below.

Figure 4A:
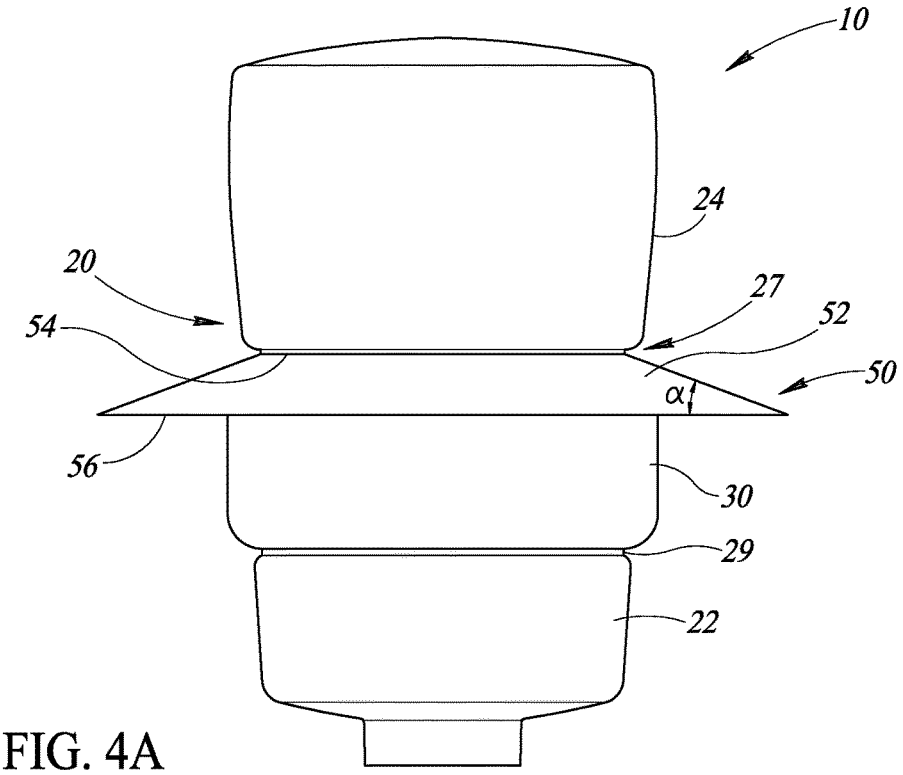
FIG. 4A is an elevational view of a shade attached to a luminaire wherein the shade is attached to a first neck portion of the luminaire and opens toward a lens of the luminaire, according to one illustrated implementation.

As shown in FIGS. 3 and 4A, during installation of the shade 50 the sheet 52 may be bent or otherwise manipulated by a user to overlap portions 64 and 66 of the sheet proximate the first and second ends 60 and 62, respectively, to form the sheet into the shape of a truncated cone (FIG. 3) with the inner edge 54 fitting around the first neck portion 27 of the luminaire 10 (FIG. 4A) disposed above the lens 30 (and LEDs 42) of the luminaire. When the shade 50 is formed into the shape of a truncated cone, as shown in FIGS. 3 and 4A, the inner arcuate edge 54 is annular in shape with a diameter which approximates the diameter of the first neck portion 27 of the luminaire 10. Since the lens 30 and the head housing portion 24 of the luminaire 10 have a larger outer contour than the first neck portion 27, the shade 50 is retained in place after installation, although in at least some implementations the shade may be selectively rotatable about the first neck portion 27 by a user to position the shade at a desired rotation.

To maintain the shade 50 in the shape of a truncated cone attached to the luminaire 10, the shade includes a fastener 68 which includes a first fastener 70 fixedly coupled to the sheet 52 proximate the first end 60 thereof and a second fastener 72 fixedly coupled to the sheet proximate the second end 62 thereof. During installation, a user may selectively engage the first fastener 70 with the second fastener 72 to selectively maintain the sheet 52 in the shape of the truncated cone around the first neck portion 27 of the luminaire 10. The fastener 68 may include a blind rivet fastener, a tab and slot fastener, an adhesive, a hook and loop fastener, or other suitable fastener. In other implementations the first and second ends 60 and 62 of the sheet 52 may be permanently fastened together using a suitable process (e.g., thermal welding, ultrasonic welding, adhesive bonding). The sheet 52 of the shade 50 may also include secondary shade attachment portions or fasteners 75 (e.g., slots, tabs, hook and loop, adhesive, snaps) which may be used to selectively attach a secondary shade to the shade 50, as discussed further below with reference to FIGS. 9 and 12.

In some implementations, the shade 50 may be fabricated from a highly reflective material (e.g., 99 percent diffusing reflectivity), such as microcellular formed polyethylene terephthalate (MCPET). In some implementations, at least one surface of the shade may be formed of or coated with a highly reflective material.

Figure 4B:
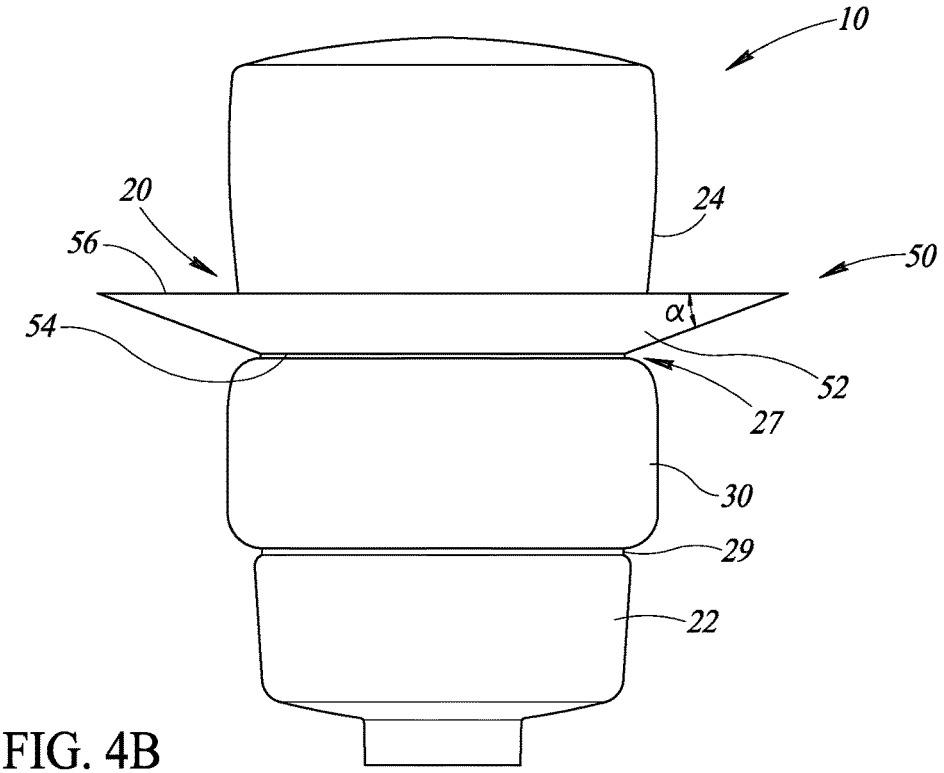
FIG. 4B is an elevational view of a shade attached to a luminaire wherein the shade is attached to the first neck portion of the luminaire and opens away from the lens of the luminaire, according to one illustrated implementation.
Figure 4C:
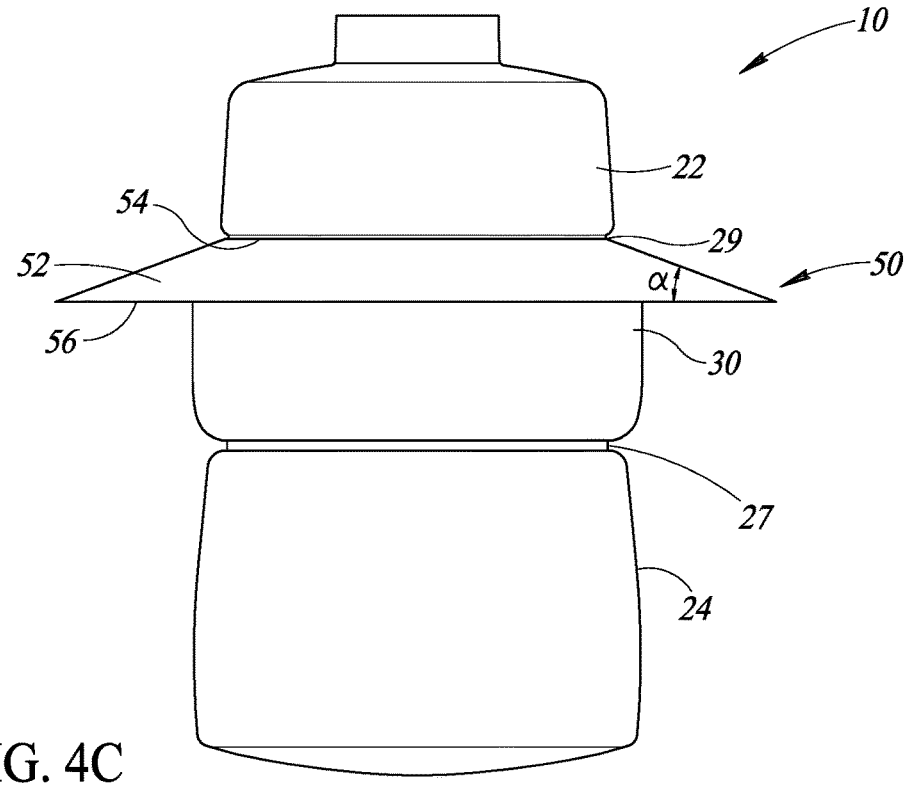
FIG. 4C is an elevational view of a shade attached to a luminaire wherein the shade is attached to a second neck portion of the luminaire and opens toward the lens of the luminaire, according to one illustrated implementation.
Figure 4D:
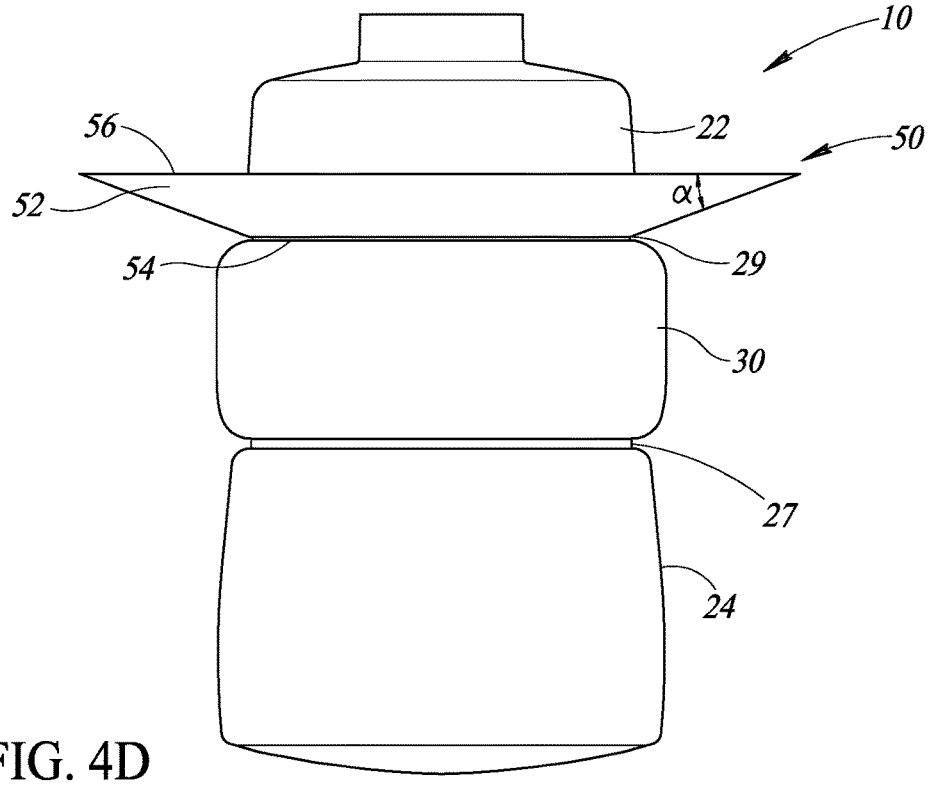
FIG. 4D is an elevational view of a shade attached to a luminaire wherein the shade is attached to the second neck portion of the luminaire and opens away from the lens of the luminaire, according to one illustrated implementation.

FIG. 4B shows an installation configuration of the shade 50 wherein the inner arcuate edge 54 is disposed around the first neck portion 27 (lens-head interface) of the luminaire 10 and the outer arcuate edge 56 is positioned above (as shown) the inner arcuate edge 54, such that the truncated cone shape of the sheet 52 opens upward (as shown) away from the lens 30. The installation configuration shown in FIG. 4B may be used for providing a small amount of uplight control, and/or for mounting a secondary shade (discussed below) where uplight may be less of a concern (see FIG. 12). FIG. 4C shows an installation of the shade 50 when the luminaire 10 is facing downward relative to the orientation shown in FIG. 4A, which is the orientation of the luminaire when used with lighting systems which have a downward facing socket which receives the threaded base 21 (see FIG. 1) of the luminaire. In this installation configuration, the inner arcuate edge 54 is disposed around the second neck portion 29 (lens-base interface) of the luminaire 10 between the lens 30 and the base housing portion 22, and the outer arcuate edge 56 is positioned below (as shown) the inner arcuate edge 54, such that the truncated cone shape of the sheet 52 opens downward toward the lens 30. FIG. 4D shows an installation of the shade 50 wherein the inner arcuate edge 54 is disposed around the second neck portion 29 of the luminaire 10 and the outer arcuate edge 56 is positioned above (as shown) the inner arcuate edge 54, such that the truncated cone shape of the sheet 52 opens upward away from the lens 30.

It should be appreciated that other installation configurations for the shade 50 (or other shades discussed herein) may be used. For example, the shade 50 may be disposed in any of the configurations shown in FIGS. 4A-4D for installations where the luminaire 10 is oriented to be coupled to an upward facing socket (FIGS. 4A and 4B) or a downward facing socket (FIGS. 4C and 4D). In other words, the truncated cone shape of the sheet 52 may open toward or away from the lens 30 when the inner arcuate edge 54 is disposed around either of the first and second neck portions 27 and 29 of the luminaire 10.

Figure 15:
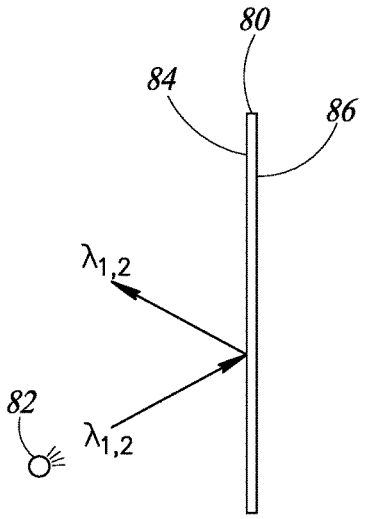
FIG. 15 is a schematic diagram of at least a portion of a primary shade or a secondary shade which reflects light, according to one illustrated implementation.

FIG. 15 shows a simplified example of a sheet 80 of highly reflective material (e.g., MCPET) which may be used to form the shade 50 or at least one surface thereof. A light source 82 (e.g., LEDs) of a luminaire emits light at wavelengths which include a first set of wavelengths, designated as $\lambda_1$ in the figures, and light at wavelengths which include a second set of wavelengths, designated as $\lambda_2$ in the figures. When the light strikes a first surface 84 of the sheet facing the light source 82, substantially all wavelengths (e.g., $\mu_2$) of the light are reflected from the first surface 84 and do not pass though the sheet to a second surface 86 which is opposite the first surface.

In some implementations, at least a portion of the shade 50 may be formed from a material which is substantially transparent (e.g., translucent, transparent) and is formed of or coated with an optical filter material which absorbs undesirable wavelengths of light (e.g., 440-480 nm wavelengths, 400-490 nm wavelengths). The remaining light therefore has a lower and more desirable color temperature.

Figure 16:
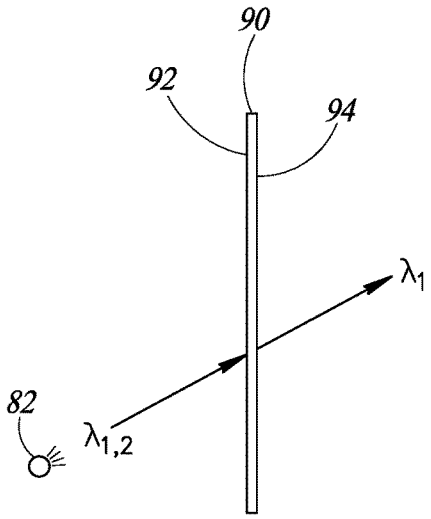
FIG. 16 is a schematic diagram of at least a portion of a primary shade or a secondary shade which absorbs light having wavelengths within a set of wavelengths, according to one illustrated implementation.

FIG. 16 shows an example of a sheet 90 of material which is substantially transparent and is formed of or coated with an optical filter material which absorbs undesirable wavelengths of light. A light source 82 (e.g., LEDs) of a luminaire emits light at wavelengths which include a first set of wavelengths, designated as $\lambda_1$ in the figures, and light at wavelengths which include a second set of wavelengths, designated as $\lambda_2$ in the figures. When the light strikes a first surface 92 of the sheet 90, the light at wavelengths in the second set of wavelengths $\lambda_2$ is absorbed and the light at wavelengths in the first set of wavelengths $\lambda_1$ passes through the material 90 and is emitted from a second surface 94 of the material opposite the first surface. Thus, the sheet 90 operates to reduce light in the second set of wavelengths $\lambda_2$.

In some implementations, at least a portion of the shade 50 may be formed from a material which is substantially transparent and is coated with an optical filter material which reflects undesirable wavelengths of light (e.g., 440-480 nm wavelengths, 400-490 nm wavelengths). As another example, at least a portion of the shade 50 may be coated with a dichroic coating or dielectric material, such as a dichroic film on a high-temperature Mylar sheet.

Figure 17:
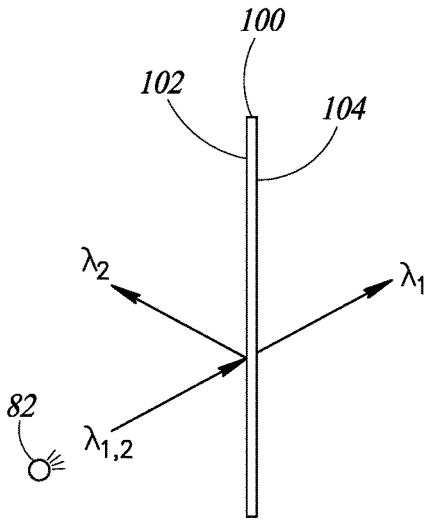
FIG. 17 is a schematic diagram of at least a portion of a primary shade or a secondary shade which reflects light having wavelengths within a set of wavelengths, according to one illustrated implementation.

FIG. 17 shows an example of a sheet 100 of material which is substantially transparent and is coated with an optical filter material which reflects undesirable wavelengths of light. A light source 82 (e.g., LEDs) of a luminaire emits light at wavelengths which include a first set of wavelengths, designated as $\lambda_1$ in the figures, and light at wavelengths which include a second set of wavelengths, designated as $\lambda_2$ in the figures. When the light strikes a first surface 102 of the sheet 100, the light at wavelengths in the second set of wavelengths $\lambda_2$ is reflected and the light at wavelengths in the first set of wavelengths $\lambda_1$ passes through the material and is emitted from a second surface 104 of the material opposite the first surface. Thus, the sheet 100 operates to reduce light in the second set of wavelengths $\lambda_2$ in an area (e.g., house side) facing the second surface 104 of the sheet 100.

In at least one implementation, at least a portion of the shade 50 may be substantially transparent and may incorporate a phosphor (e.g., a europium doped strontium-barium silicate phosphor, such as P/N O5446 available from Intematix Corporation) which operates as a wavelength shifter or converter to convert shorter wavelengths (e.g., 440-480 nm wavelengths, 400-490 nm wavelengths) into longer, more desirable wavelengths. In at least one implementation, at least a portion of the shade 50 may be substantially transparent and coated with quantum dots which convert the shorter wavelengths (e.g., 440-480 nm wavelengths) into longer, more desirable wavelengths. The coating of quantum dots may be a coating available from Quantum Materials Corporation, San Marcos, Tex., for example. The longer wavelength light may be projected onto the residential area (house side) in addition to some part of the original higher color temperature light, thereby lowering the color temperature of the light on the house side (HS) while retaining higher color temperature light on the street side (SS).

Figure 18:
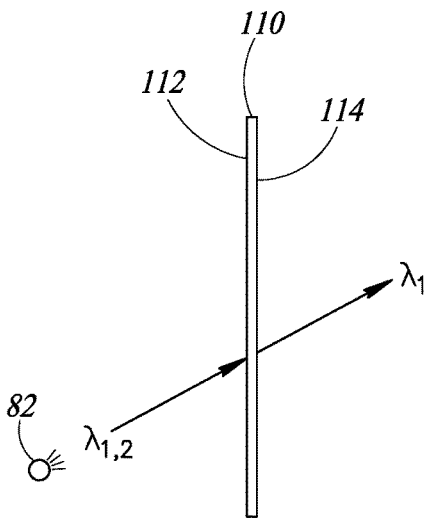
FIG. 18 is a schematic diagram of at least a portion of a primary shade or a secondary shade which converts light having wavelengths within a set of wavelengths to light having relatively longer wavelengths, according to one illustrated implementation.

FIG. 18 shows an example of a sheet 110 of material which is substantially transparent and is formed of or coated with a material which converts shorter, less desirable wavelengths of light to longer, more desirable wavelengths of light. A light source 82 (e.g., LEDs) of a luminaire emits light at wavelengths which include a first set of wavelengths, designated as $\lambda_1$ in the figures, and light at wavelengths which include a second set of wavelengths, designated as $\lambda_2$ in the figures. When the light strikes a first surface 112 of the sheet 110, the light at wavelengths in the second set of wavelengths $\lambda_2$ is converted or shifted into longer wavelengths of light (e.g., wavelengths in the set $\lambda_1$) such that only light at wavelengths in the first set of wavelengths $\lambda_1$ passes through the material and is emitted from a second surface 114 of the material opposite the first surface.

Returning to FIGS. 3 and 4A-4D, the outer arcuate edge 56 of the shade 50 may be annular in shape when in the installed position and may have a diameter of 5.5 inches, for example. Further, when installed, the sheet 52 may extend upward from the outer arcuate edge 56 to the inner arcuate edge 54 at an angle $\alpha$ (e.g., 15 degrees, 20 degrees, 30 degrees) with respect to horizontal. Such angle $\alpha$ may vary dependent on the particular application and effect desired.

When the shade 50 of FIG. 4A is formed of or coated with a highly reflective material (e.g., MCPET) and installed as shown, the shade reflects high amounts of upwardly directed light downward to both reduce the light in the upward direction ("up-light") and increase the light in the downward direction ("down-light"). As an example, the shade 50 may reduce the percentage of up-light from 50 percent down to 16 percent with very little loss of light.

Figure 5:
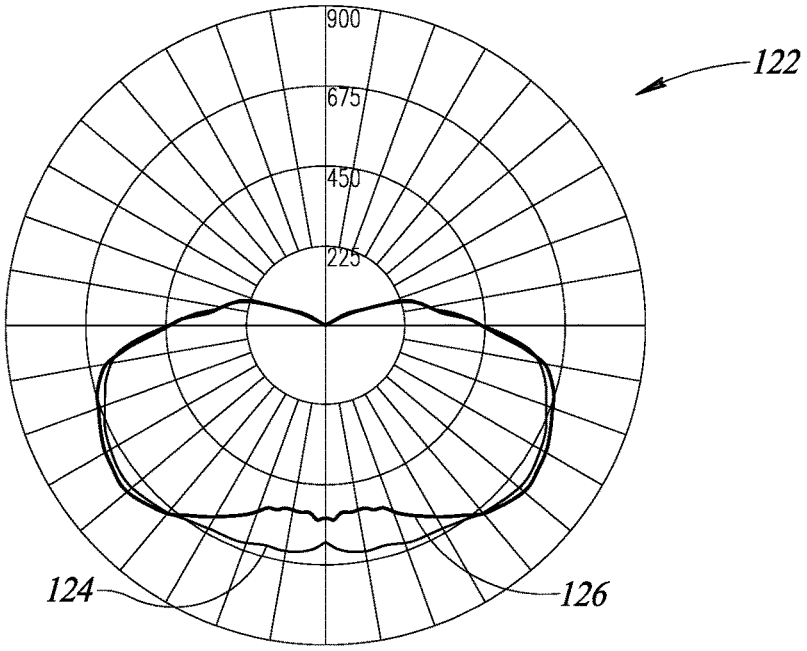
FIG. 5 is a polar luminous intensity graph which shows the distribution of luminous intensity for a luminaire and shade configured as shown in FIG. 4A and for a luminaire and shade configured as shown in FIG. 4C, according to one illustrated implementation.

FIG. 5 is a polar luminous intensity graph 122 which shows the distribution of luminous intensity for a luminaire and shade as shown in FIG. 4A, indicated by line 124, and for a luminaire and shade as shown in FIG. 4C, indicated by line 126.

Figure 6:
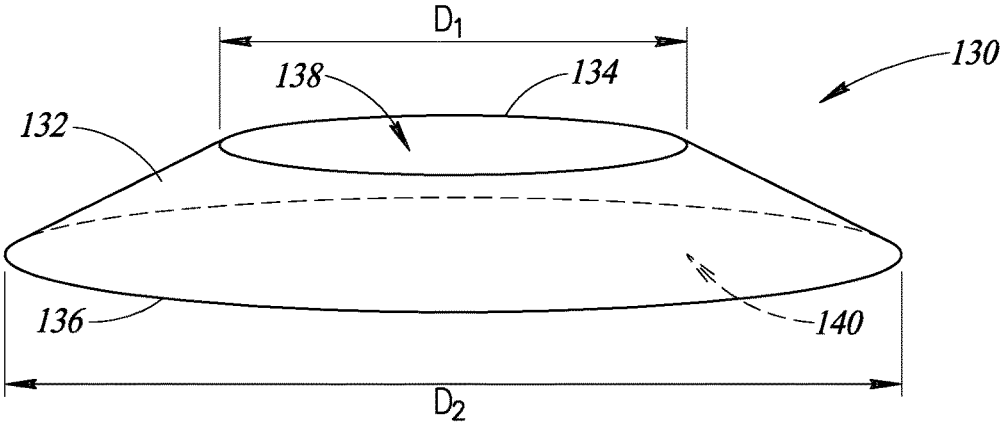
FIG. 6 is a perspective view of another implementation of a shade, according to one illustrated implementation.

FIG. 6 shows another implementation of a shade 130 which may be formed from a single piece (or multiple pieces) of an elastomeric resin (e.g., molded liquid silicone rubber). The shade 130 may have similar or identical reflective, transmissive, shifting and/or filtering properties as the shade 50 discussed above with reference to FIGS. 2-4 and 16-19. The shade 130 includes a truncated cone-shaped sheet 132 which has a first end 134 and a second end 136 opposite the first end. The first end 134 has a first opening 138 which has first diameter D1, and the second end 136 has a second opening 140 which has a second diameter D2 that is larger than the first diameter. The first diameter D1 may be smaller than the head housing portion 24 (FIG. 1) of the luminaire 10. During installation, the sheet 132 may be elastically deformed by a user to stretch the first opening 138 of the first end 134 over one of the head housing portion 24 or the base housing portion 22 of the luminaire 10 to position the first end adjacent one of the first neck portion 27 or the second neck portion 29 of the luminaire 10 to be retained in position. Like the shade 50, the shade 130 may be installed in a configuration wherein the truncated cone shape opens toward the lens 30 or opens away from the lens.

Figure 7:
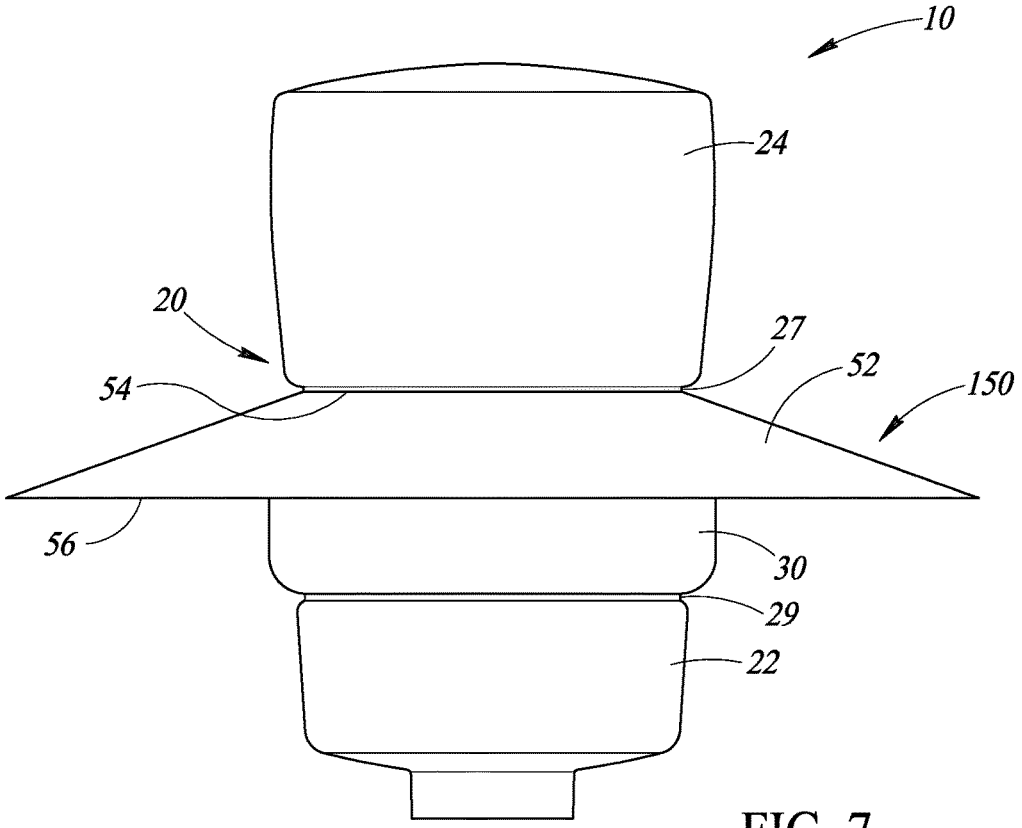
FIG. 7 is a perspective view of another implementation of shade attached to a luminaire, according to one illustrated implementation.

FIG. 7 shows another implementation of a shade 150. The shade 150 may be similar to the shades 50 and 130 of FIG. 4A-4D and 6, respectively. In this implementation, the outer edge 56 of the shade 150 forms an opening having a relatively larger diameter (e.g., 7.5 inches) relative to the outer edge 56 of the shade 50 of FIG. 4A. The shade 150 may be used for applications where a larger shade is desired to control the distribution of light from the luminaire 10. The shade 150 may be selectively coupled proximate the first or second neck portions 27 and 29 and may be oriented so that the truncated cone shape opens toward the lens 30 or opens away from the lens.

Figure 8:
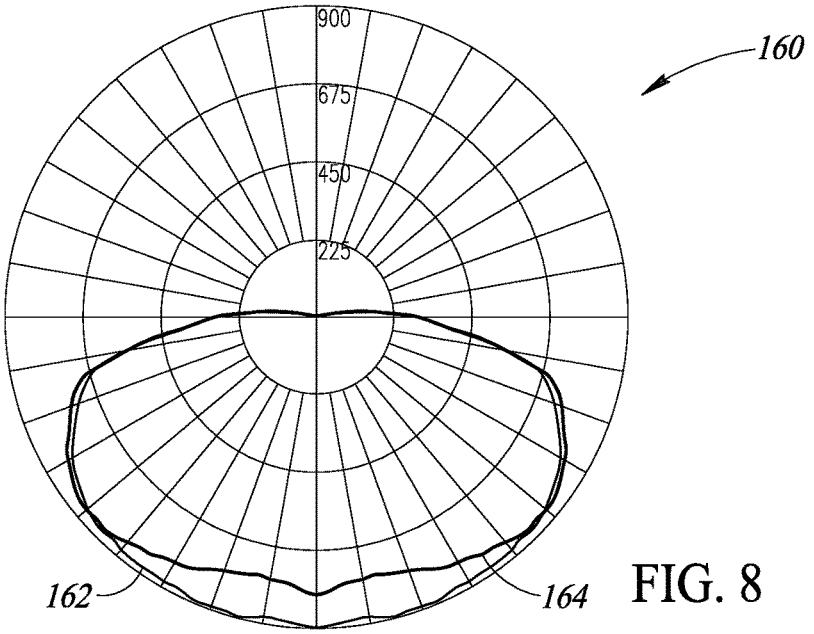
FIG. 8 shows a polar luminous intensity graph indicates the distribution of luminous intensity for a luminaire when the luminaire is coupled to an upward facing socket and the shade of FIG. 7 is coupled to a first neck portion and directed in a downward-facing configuration toward the lens, and indicates the distribution of luminous intensity for a luminaire when the luminaire is coupled to a downward facing socket and the shade of FIG. 7 is coupled to the second neck portion and directed in a downward-facing configuration toward the lens 30, according to one illustrated implementation.

FIG. 8 shows a polar luminous intensity graph 160 which shows a line 162 which indicates the distribution of luminous intensity for a luminaire 10 when the luminaire is coupled to an upward facing socket and the shade 150 of FIG. 7 is coupled to the first neck portion 27 and directed in a downward-facing configuration toward the lens 30. The graph 160 also shows a line 164 which indicates the distribution of luminous intensity for the luminaire 10 when the luminaire is coupled to a downward facing socket (see FIGS. 4C and 4D) and the shade 150 of FIG. 7 is coupled to the second neck portion 29 and directed in a downward-facing configuration toward the lens 30.

Figure 9:
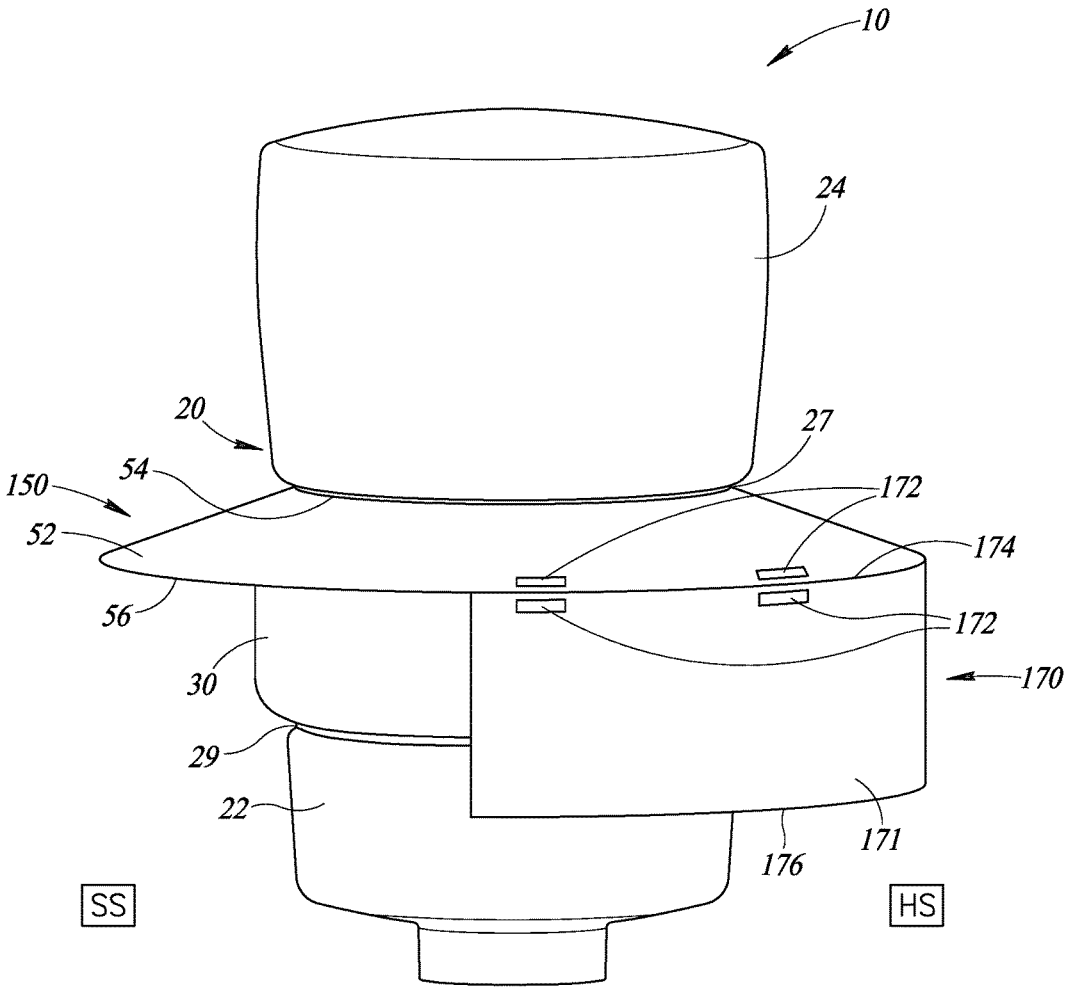
FIG. 9 is a perspective view of a primary shade and a secondary shade attached to a luminaire, according to one illustrated implementation.

FIG. 9 shows an implementation of the shade 150 of FIG. 7 which includes a secondary shade 170 selectively attached to the shade 150 proximate the outer edge 56 thereof by one or more suitable fasteners 172, such as one or more tab and slot fasteners, hook and loop fasteners, an adhesive, etc. The secondary shade 170 comprises a sheet 171 having an upper end 174 which includes the fasteners 172, and a lower end 176 opposite the upper end. The secondary shade 170 is positioned between the lens 30 of the luminaire 10 and a house side (HS) of the luminaire to prevent light trespass on areas where high light levels are not desired, such as residences ("house side"). During or subsequent to installation, the shade 150 may be rotated about the first neck portion 27 of the luminaire 10 such that the secondary shade 170 is oriented toward an area where light is intended to be blocked or filtered, regardless of the final rotational position ("clocking") of the screw-in retrofit luminaire 10.

The secondary shade 170 may be formed of or coated with any of the materials discussed above so that the secondary shade provides desired reflective, absorptive, filtering and/or wavelength shifting properties for a particular application. For example, the secondary shade 170 may be formed of or coated with a highly reflective material (e.g., MCPET) which causes light emitted from the LEDs 42 (FIG. 1) of the luminaire 10 in the direction of the secondary shade to be reflected away from the side of the luminaire 10 on which the secondary shade is positioned and toward an opposite side (e.g., street side) of the luminaire.

The secondary shade 170 may be sized and dimensioned extend around various portions of the shade 150, depending on the particular application. For example, the secondary shade may be sized and dimensioned to span an arc which comprises 25 percent (e.g., 90 degrees), 27 percent (e.g., 100 degrees), 50 percent (e.g., 180 degrees), etc., of the shade 150, dependent on the particular area where the light is intended to be modified (e.g., reflected, filtered).

Various implementations of the secondary shade 170 may be sized and dimensioned to selectively of fixedly couple to any of the shades discussed herein when the shades are installed in various configurations. Generally, the secondary shade 170 extends from a primary shade to which the secondary shade is attached in a direction which is toward the lens 30 of the luminaire 10, as shown in FIGS. 9 and 12.

Figure 10:
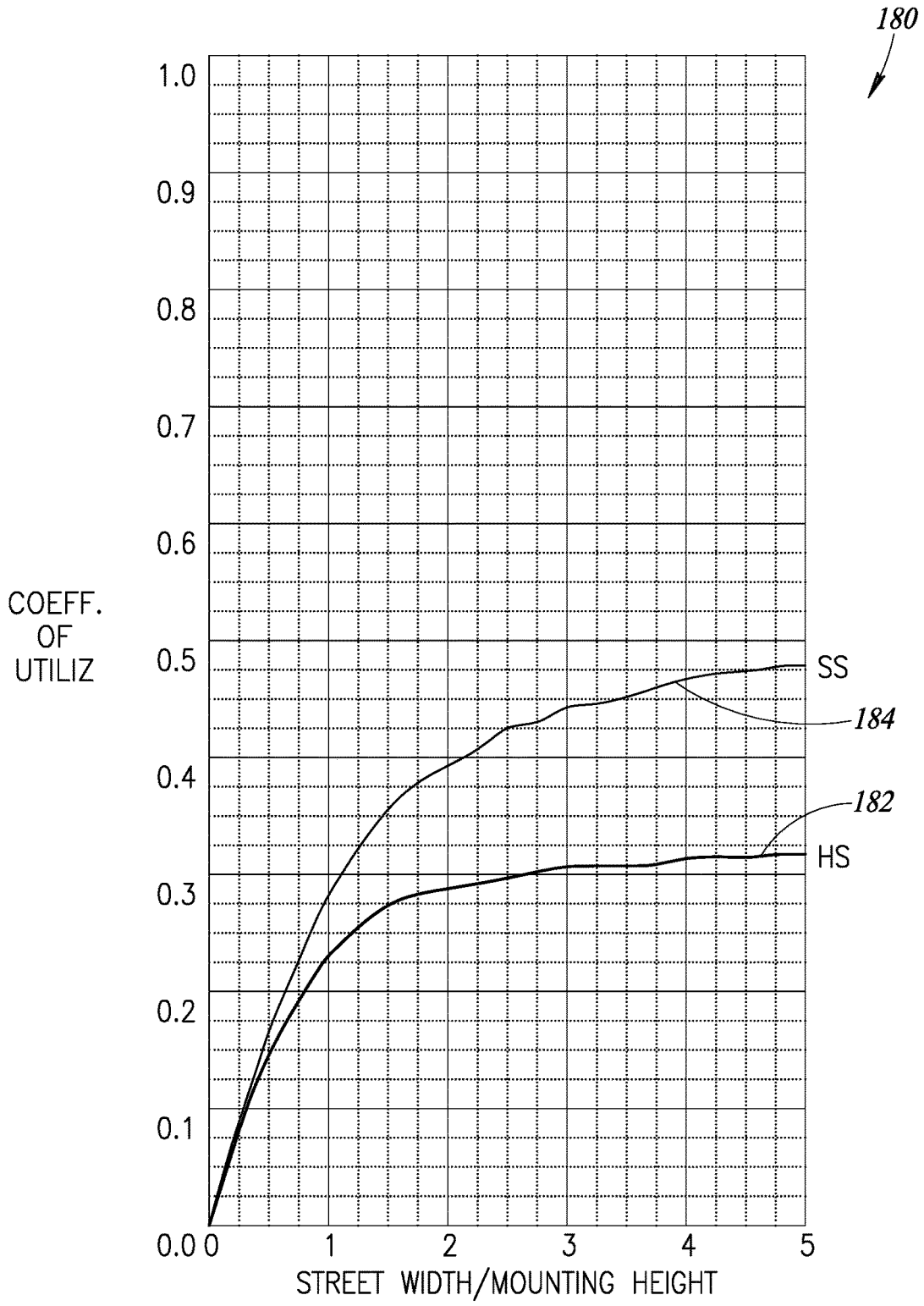
FIG. 10 is a plot which shows a coefficient of utilization for the luminaire, primary shade and secondary shade of FIG. 9, according to one illustrated implementation.
Figure 11:
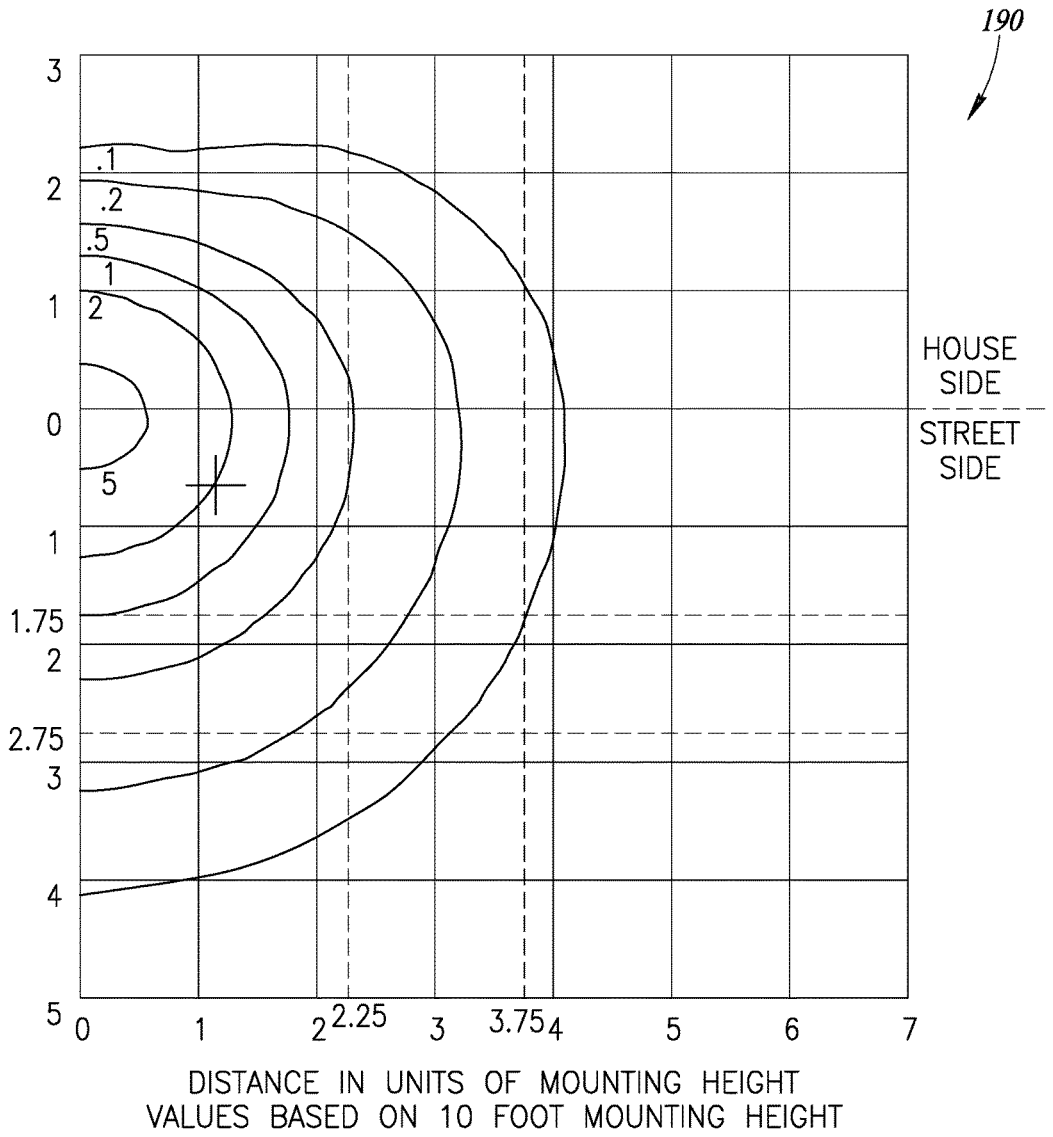
FIG. 11 is a plot which shows the distribution of luminous intensity for the luminaire, primary shade and secondary shade of FIG. 9, according to one illustrated implementation.

FIG. 10 shows a plot 180 of a coefficient of utilization for the luminaire 10, primary shade 150 and secondary shade 170 of FIG. 9 in a house side direction, indicated by numeral 182, and a street side direction, indicated by numeral 184. FIG. 11 shows a plot 190 of the distribution of luminous intensity for the luminaire 10, primary shade 150 and secondary shade 170 of FIG. 9 for the house side and street side of the luminaire.

Figure 12:
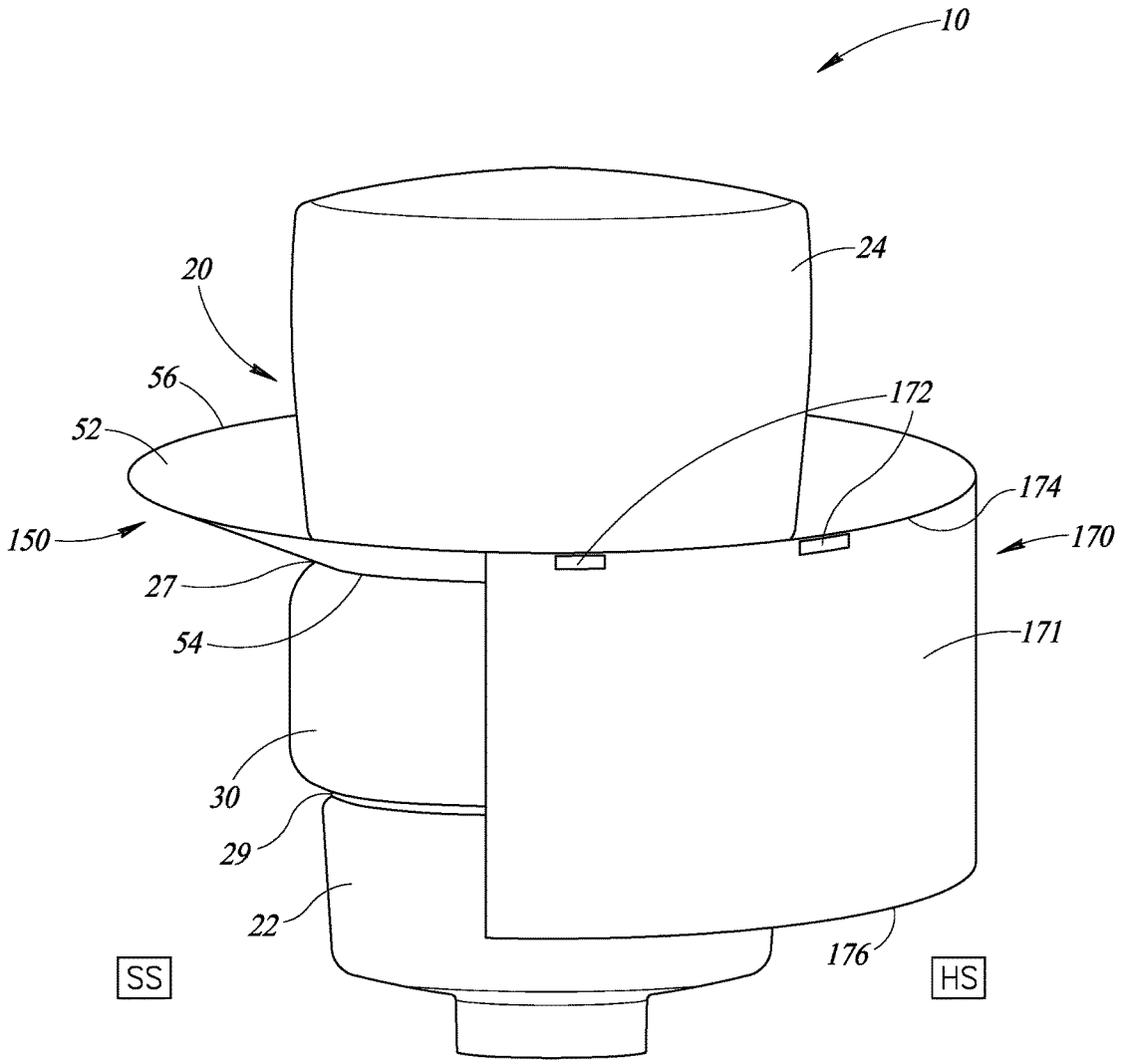
FIG. 12 is a perspective view of an upward-facing shade and a secondary shade attached to a luminaire, according to one illustrated implementation.

FIG. 12 shows the shade 150 of FIG. 9 when positioned in an upward-facing configuration wherein the outer edge 56 of the shade is disposed above the inner edge 54 of the shade such that the truncated cone shape of the shade 150 opens upward away from the lens 30 of the luminaire 10. Similar to the implementation shown in FIG. 9, the upward-facing shade 150 includes the secondary shade 170 selectively attached to the shade proximate the outer edge 56 thereof by the one or more suitable fasteners 172. The secondary shade 170 extends downward from the shade 150 toward the lens 30 to prevent light trespass on areas where high light levels are not desired, such as residences ("house side"). During or subsequent to installation, the shade 150 may be rotated about the first neck portion 27 of the luminaire 10, or the second neck portion 29 in instances where the shade 150 is attached to the second neck portion, such that the secondary shade 170 is oriented toward an area where light is intended to be blocked or filtered, regardless of the final rotational position ("clocking") of the screw-in retrofit luminaire.

Figure 13:
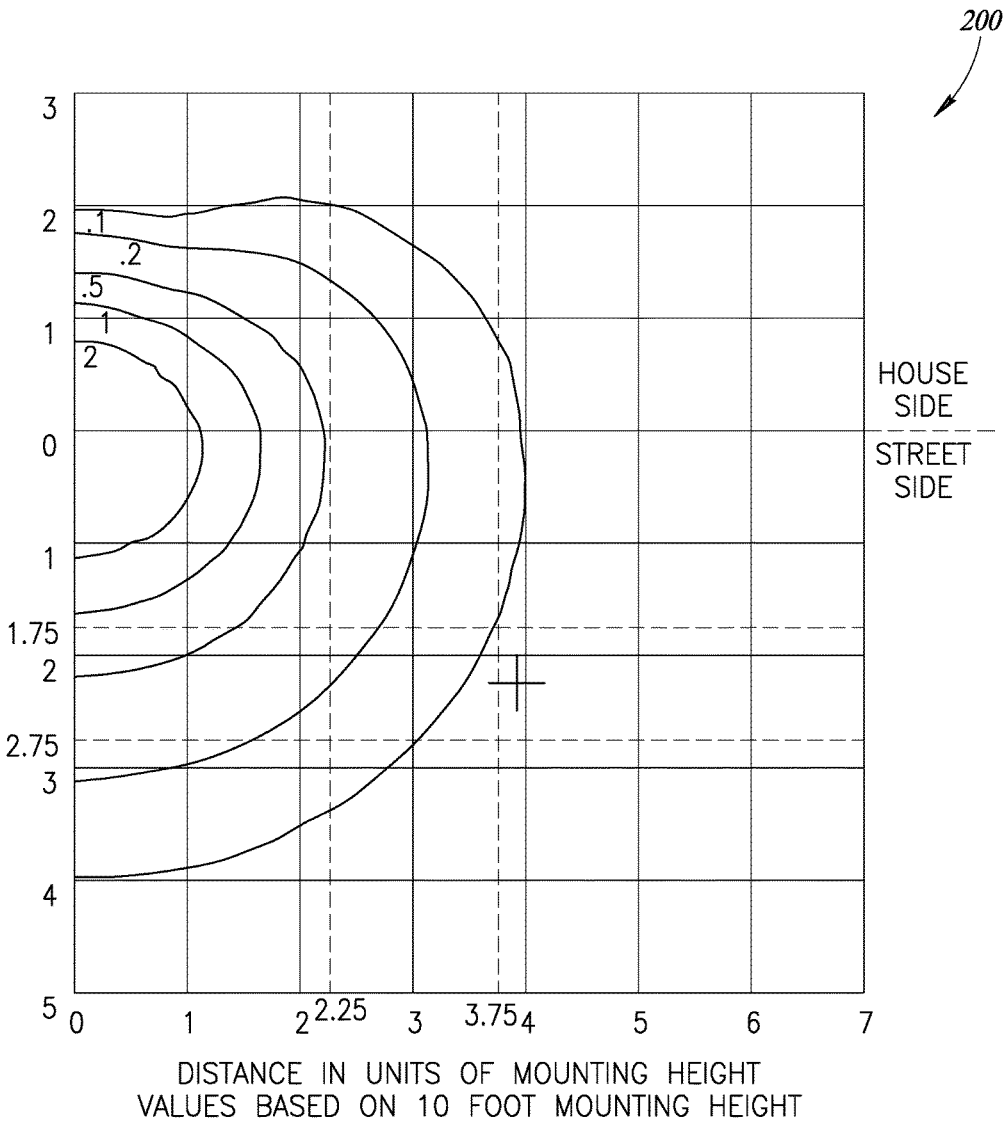
FIG. 13 is a plot which shows the distribution of luminous intensity for the luminaire, primary shade and secondary shade of FIG. 12, according to one illustrated implementation.
Figure 14:
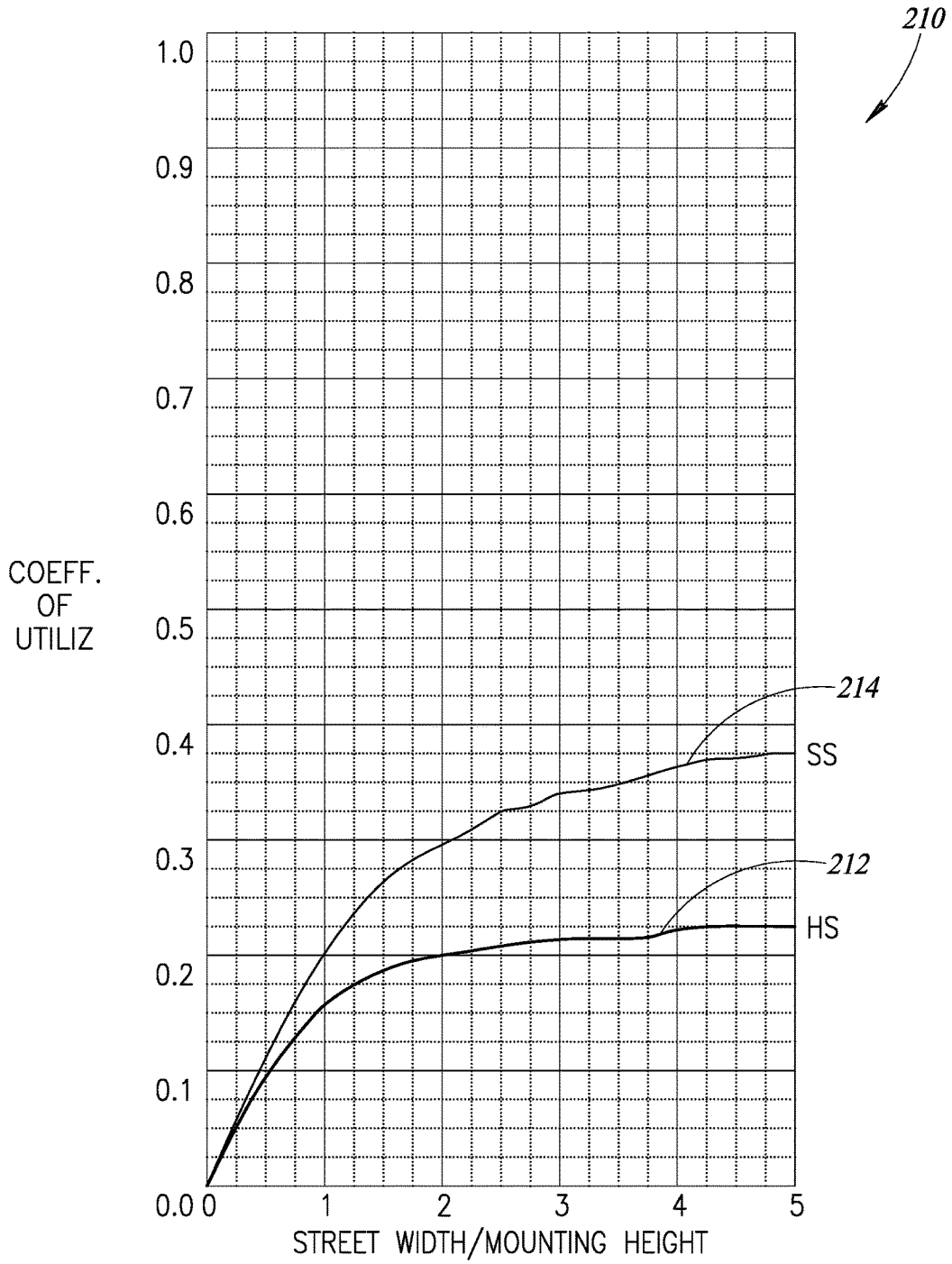
FIG. 14 is a plot whish shows a coefficient of utilization for the luminaire, primary shade and secondary shade of FIG. 12, according to one illustrated implementation.

FIG. 13 shows a plot 200 of the distribution of luminous intensity for the luminaire 10, primary shade 150 and secondary shade 170 of FIG. 12 when the primary shade is in the upward-facing configuration. FIG. 14 shows a plot 210 of a coefficient of utilization for the luminaire, primary shade and secondary shade of FIG. 12 for the house-side, indicated by numeral 212, and street side, indicated by numeral 214 of the luminaire 10.

As one of skill in the art will recognize, the optical elements discussed herein (e.g., reflectors, absorbers, filters, wavelength shifters) may not have precise cut off values. Thus, the terms "substantially" and "approximately" are used herein to denote the inherent impreciseness of such optical elements. Generally, any optical element that is at least 80% effective within 25% of the denominated value will suffice, although in some implementations even lower efficiencies and wider ranges may be suitable.

Suitable semiconductor materials (i.e., phosphors) may include: gallium arsenide (GaAs), aluminum gallium arsenide (AlGaAs), gallium arsenide phosphide (GaAsP), gallium arsenide indium phosphide (GaAsInP), gallium (III) phosphide (GaP), aluminum gallium indium phosphide (AlGaInP), indium gallium nitride (InGaN)/gallium (III) nitride (GaN), aluminum gallium phosphide (AlGaP), zinc selenide (ZnSe), and/or a europium doped strontium-barium silicate phosphor. The selection of particular materials may be governed by the desired wavelength of the output.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of materials.

The various implementations described above can be combined to provide further implementations. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet, including but not limited to U.S. Provisional Patent Application No. 61/052,924, filed May 13, 2008; U.S.

Pat. No. 8,926,138, issued Jan. 6, 2015; PCT Publication No. WO2009/140141, published Nov. 19, 2009; U.S. Provisional Patent Application No. 61/051,619, filed May 8, 2008; U.S. Pat. No. 8,118,456, issued Feb. 21, 2012; PCT Publication No. WO2009/137696, published Nov. 12, 2009; U.S. Provisional Patent Application No. 61/088,651, filed Aug. 13, 2008; U.S. Pat. No. 8,334,640, issued Dec. 18, 2012; U.S. Provisional Patent Application No. 61/115,438, filed Nov. 17, 2008; U.S. Provisional Patent Application No. 61/154,619, filed Feb. 23, 2009; U.S. Patent Publication No. 2010/0123403, published May 20, 2010; U.S. Patent Publication No. 2016/0021713, published Jan. 21, 2016; PCT Publication No. WO2010/057115, published May 20, 2010; U.S. Provisional Patent Application No. 61/174,913, filed May 1, 2009; U.S. Pat. No. 8,926,139, issued Jan. 6, 2015; PCT Publication No. WO2010/127138, published Nov. 4, 2010; U.S. Provisional Patent Application No. 61/180,017, filed May 20, 2009; U.S. Pat. No. 8,872,964, issued Oct. 28, 2014; U.S. Patent Publication No. 2015/0015716, published Jan. 15, 2015; PCT Publication No. WO2010/135575, published Nov. 25, 2010; U.S. Provisional Patent Application No. 61/229,435, filed Jul. 29, 2009; U.S. Patent Publication No. 2011/0026264, published Feb. 3, 2011; U.S. Provisional Patent Application No. 61/295,519, filed Jan. 15, 2010; U.S. Provisional Patent Application No. 61/406,490, filed Oct. 25, 2010; U.S. Pat. No. 8,378,563, issued Feb. 19, 2013; PCT Publication No. WO2011/088363, published Jul. 21, 2011; U.S. Provisional Patent Application No. 61/333,983, filed May 12, 2010; U.S. Pat. No. 8,541,950, issued Sep. 24, 2013; PCT Publication No. WO2010/135577, published Nov. 25, 2010; U.S. Provisional Patent Application No. 61/346,263, filed May 19, 2010; U.S. Pat. No. 8,508,137, issued Aug. 13, 2013; U.S. Pat. No. 8,810,138, issued Aug. 19, 2014; U.S. Pat. No. 8,987,992, issued Mar. 24, 2015; PCT Publication No. WO2010/135582, published Nov. 25, 2010; U.S. Provisional Patent Application No. 61/357,421, filed Jun. 22, 2010; U.S. Pat. No. 9,241,401, granted Jan. 19, 2016; PCT Publication No. WO2011/163334, published Dec. 29, 2011; U.S. Pat. No. 8,901,825, issued Dec. 2, 2014; U.S. Patent Publication No. 2015/0084520, published Mar. 26, 2015; PCT Publication No. WO2012/142115, published Oct. 18, 2012; U.S. Pat. No. 8,610,358, issued Dec. 17, 2013; U.S. Provisional Patent Application No. 61/527,029, filed Aug. 24, 2011; U.S. Pat. No. 8,629,621, issued Jan. 14, 2014; PCT Publication No. WO2013/028834, published Feb. 28, 2013; U.S. Provisional Patent Application No. 61/534,722, filed Sep. 14, 2011; U.S. Pat. No. 9,312,451, issued Apr. 12, 2016; PCT Publication No. WO2013/040333, published Mar. 21, 2013; U.S. Provisional Patent Application No. 61/567,308, filed Dec. 6, 2011; U.S. Pat. No. 9,360,198, issued Jun. 7, 2016; U.S. Provisional Patent Application No. 61/561,616, filed Nov. 18, 2011; U.S. Patent Publication No. 2013/0141010, published Jun. 6, 2013; PCT Publication No. WO2013/074900, published May 23, 2013; U.S. Provisional Patent Application No. 61/641,781, filed May 2, 2012; U.S. Patent Publication No. 2013/0293112, published Nov. 7, 2013; U.S. Patent Publication No. 2013/0229518, published Sep. 5, 2013; U.S. Provisional Patent Application No. 61/640,963, filed May 1, 2012; U.S. Patent Publication No. 2013/0313982, published Nov. 28, 2013; U.S. Patent Publication No. 2014/0028198, published Jan. 30, 2014; U.S. Patent Publication No. 2016/0037605, published Feb. 4, 2016; PCT Publication No. WO2014/018773, published Jan. 30, 2014; U.S. Provisional Patent Application No. 61/723,675, filed Nov. 7, 2012; U.S. Pat. No. 9,301,365, issued Mar. 29, 2016; U.S. Provisional Patent Application No. 61/692,619, filed Aug. 23, 2012; U.S. Patent Publication No. 2014/0055990, published Feb. 27, 2014; U.S. Provisional Patent Application No. 61/694,159, filed Aug. 28, 2012; U.S. Pat. No. 8,878,440, issued Nov. 4, 2014; U.S. Patent Publication No. 2014/0062341, published Mar. 6, 2014; U.S. Patent Publication No. 2015/0077019, published Mar. 19, 2015; PCT Publication No. WO2014/039683, published Mar. 13, 2014; U.S. Provisional Patent Application No. 61/728,150, filed Nov. 19, 2012; U.S. Patent Publication No. 2014/0139116, published May 22, 2014; U.S. Pat. No. 9,433,062, issued Aug. 30, 2016; PCT Publication No. WO2014/078854, published May 22, 2014; U.S. Provisional Patent Application No. 61/764,395, filed Feb. 13, 2013; U.S. Pat. No. 9,288,873, issued Mar. 15, 2016; U.S. Provisional Patent Application No. 61/849,841, filed Jul. 24, 2013; U.S. Patent Publication No. 2015/0028693, published Jan. 29, 2015; PCT Publication No. WO2015/013437, published Jan. 29, 2015; U.S. Provisional Patent Application No. 61/878,425, filed Sep. 16, 2013; U.S. Patent Publication No. 2015/0078005, published Mar. 19, 2015; PCT Publication No. WO2015/039120, published Mar. 19, 2015; U.S. Provisional Patent Application No. 61/933,733, filed Jan. 30, 2014; U.S. Pat. No. 9,185,777, issued Nov. 10, 2015; PCT Publication No. WO2015/116812, published Aug. 6, 2015; U.S. Provisional Patent Application No. 61/905,699, filed Nov. 18, 2013; U.S. Pat. No. 9,414,449, issued Aug. 9, 2016; U.S. Provisional Patent Application No. 62/068,517, filed Oct. 24, 2014; U.S. Provisional Patent Application No 62/183,505, filed Jun. 23, 2015; U.S. Pat. No. 9,445,485, issued Sep. 13, 2016; PCT Publication No. WO2016/064542, published Apr. 28, 2016; U.S. Provisional Patent Application No. 62/082,463, filed Nov. 20, 2014; U.S. Publication No. 2016/0150369, published May 26, 2016; PCT Publication No. WO2016/081071, published May 26, 2016; U.S. Provisional Patent Application No. 62/057,419, filed Sep. 30, 2014; U.S. Publication No. 2016/0095186, published Mar. 31, 2016; PCT Publication No. WO2016/054085, published Apr. 7, 2016; U.S. Provisional Patent Application No. 62/114,826, filed Feb. 11, 2015; U.S. Non-provisional patent application Ser. No. 14/939,856, filed Nov. 12, 2015; U.S. Provisional Patent Application No. 62/137,666, filed Mar. 24, 2015; U.S. Non-provisional patent application Ser. No. 14/994,569, filed Jan. 13, 2016; U.S. Non-provisional patent application Ser. No. 14/844,944, filed Sep. 3, 2015; U.S. Provisional Patent Application No. 62/208,403, filed Aug. 21, 2015; U.S. Non-provisional patent application Ser. No. 15/238,129, filed Aug. 16, 2016; U.S. Provisional Patent Application No. 62/264,694, filed Dec. 8, 2015; U.S. Non-provisional Patent Application No. 15/369,559, filed Dec. 5, 2016; U.S. Provisional Patent Application No. 62/397,709, filed Sep. 21, 2016; U.S. Provisional Patent Application No. 62/397,713, filed Sep. 21, 2016; U.S. Provisional Patent Application No. 62/327,939, filed Apr. 26, 2016; U.S. Non-provisional patent application Ser. No. 15/496,985, filed Apr. 25, 2017; U.S. Provisional Patent Application No. 62/379,037, filed Aug. 24, 2016; U.S. Provisional Patent Application No. 62/458,970, filed Feb. 14, 2017; U.S. Provisional Patent Application No. 62/480,833, filed Apr. 3, 2017; and U.S. Provisional Patent Application No. 62/507,730, filed May 17, 2017 are incorporated herein by reference, in their entirety.

Aspects of the implementations can be modified, if necessary, to employ systems, circuits and concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A shade assembly to control an illumination pattern of a luminaire, the shade assembly comprising:

a primary shade comprising a sheet of material having inner and outer arcuate edges concentric about a central axis, the inner and outer arcuate edges extending between first and second ends of the sheet, the sheet bendable by a user to overlap portions of the sheet adjacent the first and second ends to form the sheet into the shape of a truncated cone with at least a portion of the inner edge fitting around a neck portion of the luminaire disposed at least one of above or below at least one light source of the luminaire, the sheet of material comprises at least one reflective surface;

a fastener which selectively maintains the sheet in the shape of the truncated cone around the neck portion of the luminaire; and a secondary shade that is selectively attachable to the primary shade.

2. The shade assembly of claim 1 wherein the sheet of material of the primary shade comprises a sheet of microcellular formed polyethylene terephthalate (MCPET).

3. The shade assembly of claim 1 wherein the secondary shade comprises a sheet of material which, when attached to the shade, extends from at least a portion of the outer arcuate edge of the primary shade toward the at least one light source of the luminaire.

4. The shade assembly of claim 3 wherein the secondary shade extends from at least 25 percent of the outer arcuate edge of the primary shade.

5. The shade assembly of claim 3 wherein the secondary shade extends from at least 50 percent of the outer arcuate edge of the primary shade.

6. The shade assembly of claim 1 wherein the secondary shade is at least one of optically transparent or optically translucent.

7. The shade assembly of claim 6 wherein the secondary shade is formed of or coated with an optical filter material which transmits light incident on the secondary shade having a wavelength in a first set of wavelengths and one of reflects or absorbs light incident on the secondary shade having a wavelength in a second set of wavelengths.

8. The shade assembly of claim 7 wherein the secondary shade is formed of or coated with an optical filter material which one of reflects or absorbs light incident on the secondary shade having a wavelength below 480 nanometers.

9. The shade assembly of claim 7 wherein at least one surface of the secondary shade includes a dielectric coating disposed thereon.

10. The shade assembly of claim 1 wherein the secondary shade comprises a wavelength shifter portion which receives light from the at least one light source of the luminaire on a first surface of the secondary shade and in response emits light at a shifted wavelength on a second surface of the secondary shade, the second surface of the secondary shade opposite the first surface of the secondary shade.

11. The shade assembly of claim 10 wherein the wavelength shifter portion of the secondary shade emits light at wavelengths above 480 nanometers.

12. The shade assembly of claim 10 wherein the wavelength shifter portion of the secondary shade comprises the sheet loaded with phosphor.

13. The shade assembly of claim 10 wherein the wavelength shifter portion of the secondary shade comprises the secondary shade loaded with a europium doped strontium-barium silicate phosphor.

14. The shade assembly of claim 10 wherein the wavelength shifter portion of the secondary shade comprises a coating of quantum dots disposed on at least one surface of the secondary shade.

15. The shade assembly of claim 1 wherein at least one surface of the secondary shade comprises a reflective surface.

16. The shade assembly of claim 1 wherein the secondary shade comprises a sheet of microcellular formed polyethylene terephthalate (MCPET).

* * * * *